US012317947B2

(12) United States Patent
Hermansen et al.

(10) Patent No.: US 12,317,947 B2
(45) Date of Patent: Jun. 3, 2025

(54) HELMET AND CHIN STRAP

(71) Applicant: Double Three, LLC, Laguna Beach, CA (US)

(72) Inventors: Frank Hermansen, Corona del Mar, CA (US); Carl Winefordner, Laguna Beach, CA (US)

(73) Assignee: DoubleThree, LLC, Laguna Beach, CA (US)

( * ) Notice: Subject to any disclaimer, the term of this patent is extended or adjusted under 35 U.S.C. 154(b) by 0 days.

(21) Appl. No.: 18/363,516

(22) Filed: Aug. 1, 2023

(65) Prior Publication Data

US 2024/0315375 A1 Sep. 26, 2024

Related U.S. Application Data

(60) Provisional application No. 63/491,666, filed on Mar. 22, 2023.

(51) Int. Cl.
*A42B 3/08* (2006.01)
*A42B 3/32* (2006.01)

(52) U.S. Cl.
CPC . *A42B 3/08* (2013.01); *A42B 3/32* (2013.01)

(58) Field of Classification Search
CPC ..... A42B 3/08
See application file for complete search history.

(56) References Cited

U.S. PATENT DOCUMENTS 1,251,959 A * 1/1918 Brodie ..... A42B 3/08 D29/104
2,205,741 A 6/1940 Bowers
2,511,234 A 6/1950 Anderson
2,926,406 A 3/1960 Edwards et al.
3,041,622 A 7/1962 Gurtowski
3,075,201 A 1/1963 Lindblom
(Continued)

FOREIGN PATENT DOCUMENTS

CN 202819772 U 3/2013
CN 111631481 A 9/2020
(Continued)

OTHER PUBLICATIONS

Patent Cooperation Treaty, International Search Report and Written Opinion for International Application No. PCT/US2021/046763, mailed Sep. 16, 2021, 10 pages.
(Continued)

*Primary Examiner* — Sally Haden
(74) *Attorney, Agent, or Firm* — Stetina Garred Brucker & Newboles

(57) ABSTRACT

A helmet comprises a shell having a front portion, a rear portion, and a pair of lateral portions extending between the front portion and the rear portion. The shell is sized and configured to be placeable on the head of a user. The helmet additionally includes a chin strap having a pair of end portions and an intermediate portion located between the pair of end portions. The end portions are fixedly connected to respective ones of the pair of lateral portions of the shell so as to restrict movement of the end portions relative to the shell. The chin strap is flexible to facilitate placement of the chin strap around a chin of a user in connection with placement of the shell on the head of the user.

10 Claims, 15 Drawing Sheets

(56) References Cited

U.S. PATENT DOCUMENTS

| | | | |
|---|---|---|---|
| 3,214,809 | A | 11/1965 | Edwards |
| 3,325,824 | A | 6/1967 | Donegan |
| 3,444,560 | A | 5/1969 | Northup, Jr. |
| 3,478,365 | A | 11/1969 | Varga |
| 3,572,329 | A | 3/1971 | Woskin |
| 4,398,306 | A | 8/1983 | Gooding |
| 4,434,514 | A | 3/1984 | Sundahl et al. |
| 4,641,382 | A | 2/1987 | Gessalin |
| 4,885,806 | A | 12/1989 | Heller |
| 4,888,831 | A | 12/1989 | Oleson |
| 5,077,839 | A | 1/1992 | Keller |
| 5,357,654 | A | 10/1994 | Hsing-Chi |
| 5,571,220 | A | 11/1996 | Hall |
| 5,915,538 | A | 6/1999 | Basson |
| 5,950,245 | A | 9/1999 | Binduga |
| 5,987,652 | A | 11/1999 | Fowler |
| 6,708,376 | B1 | 3/2004 | Landry |
| 7,114,197 | B2 | 10/2006 | Garneau et al. |
| 7,707,695 | B2 | 5/2010 | Dubois |
| 8,032,993 | B2 | 10/2011 | Musal |
| 8,635,715 | B2 | 1/2014 | Hunt et al. |
| 10,251,451 | B2 | 4/2019 | Converse et al. |
| 10,485,282 | B2 | 11/2019 | Coursimault |
| 11,089,831 | B1 | 8/2021 | Hermansen |
| D982,835 | S | 4/2023 | Cao |
| 2003/0106138 | A1 | 6/2003 | Guay |
| 2009/0082835 | A1 | 3/2009 | Jaax |
| 2009/0265841 | A1 | 10/2009 | Ferrara |
| 2010/0170068 | A1 | 7/2010 | Musal |
| 2010/0319109 | A1 | 12/2010 | Field |
| 2011/0088148 | A1 | 4/2011 | Chen |
| 2011/0113519 | A1 | 5/2011 | Gendron et al. |
| 2012/0204330 | A1 | 8/2012 | Albouy |
| 2012/0251328 | A1 | 10/2012 | Connor |
| 2012/0278976 | A1 | 11/2012 | Benton |
| 2013/0031702 | A1 | 2/2013 | Gafforio |
| 2015/0107006 | A1 | 4/2015 | Chen |
| 2016/0270470 | A1* | 9/2016 | Hickman ..... A42B 3/08 |
| 2017/0215512 | A1 | 8/2017 | Zhang |
| 2017/0325534 | A1 | 11/2017 | Noordzij et al. |
| 2018/0064197 | A1 | 3/2018 | Finquel et al. |
| 2018/0092424 | A1 | 4/2018 | Hall |
| 2019/0269193 | A1 | 9/2019 | Benyola |
| 2019/0350296 | A1 | 11/2019 | Sanders |
| 2021/0153594 | A1 | 5/2021 | Rogers |

FOREIGN PATENT DOCUMENTS

| | | | |
|---|---|---|---|
| DE | 04444188 | A1 | 6/1996 |
| DE | 10040509 | C2 | 12/2003 |
| EP | 0270368 | A1 | 6/1988 |
| EP | 0558427 | A1 | 9/1993 |
| EP | 2123182 | A2 | 11/2009 |
| EP | 3094199 | B1 | 7/2019 |
| EP | 3373759 | B1 | 12/2019 |
| FR | 2831774 | A1 | 5/2003 |
| FR | 2838611 | A1 | 10/2003 |
| JP | 2003253519 | A | 9/2003 |
| JP | 2017160589 | A | 9/2017 |
| JP | 2017538052 | A | 12/2017 |
| KR | 101385672 | B1 | 4/2014 |
| KR | 10-2021-0150257 | A | 12/2021 |
| WO | 2011/051989 | A1 | 5/2011 |
| WO | WO2014163404 | | 10/2014 |

OTHER PUBLICATIONS

European Patent Office, European search report for Application No. 21815090.2, Oct. 4, 2023, 23 pages.

Patent Cooperation Treaty, International Search Report and Written Opinion for International Application No. PCT/US2024/020445, Jul. 29, 2024, 13 pages.

Suga, Hitomi; Japanese Office Action; Japanese Patent Application No. 2023-524706; Dated Jan. 28, 2025; 5 pages.

* cited by examiner

HELMET AND CHIN STRAP

CROSS-REFERENCE TO RELATED APPLICATIONS

This application claims the benefit of U.S. Provisional Application Ser. No. 63/491,666 filed Mar. 22, 2023, the contents of which are expressly incorporated herein by reference.

STATEMENT RE: FEDERALLY SPONSORED RESEARCH/DEVELOPMENT

Not Applicable

BACKGROUND

1. Technical Field

The present disclosure generally relates to an improved retention system for a helmet. More specifically, the present disclosure relates to an easily adjustable chin strap apparatus for a helmet.

2. Related Art

Safety helmets are well known and may be worn when participating in a wide variety of activities, including but not limited to, many different areas of recreation, transportation, military, and construction. For example, helmets are typically worn while cycling, snowboarding and skiing, skateboarding, rock climbing, football, baseball, field hockey, ice hockey, horse riding, scooter and motorcycle riding, on battle fields, and on construction sites, to name a few. One aspect that nearly every conventional helmet has in common is one or more flexible webbing straps that connect under the user's chin to help keep the helmet in place on the wearer's head.

Conventional safety helmets typically worn by users participating in activities requiring head protection, such as for example cyclists, may include a domed-shaped body in various sizes and shapes. Fastening chin straps may be required to retain the helmet more securely in position on the wearer's head. The chin straps may include flexible webbing and a buckle to form a helmet retention system which may be mounted to the helmet and extend under the chin of the helmet wearer during use. In many helmets, one strap may be connected to the helmet behind each of the user's cars and another strap may be connected to the helmet in front of each of the user's cars. On each side, these straps may be connected together to effectively form a single strap. The two single straps may be adjustable in length to achieve a tight fit under the user's chin.

Helmet chin straps assist in maintaining the helmet securely attached to the wearer's head. Indeed, not only do they minimize the occurrences of vertical movement of the helmet being projected off of the wearer's head, but they also generally help to minimize the occurrences where the helmet is pivoted off of or out of position on the front or rear portion of the wearer's head, exposing vulnerable parts of the user's head to impact.

These straps are typically difficult to adjust properly, and thus, many users wear helmets that are improperly adjusted, which may mitigate the effectiveness of the safety helmet. For example, it may be difficult to adjust the straps so that on a given side of the helmet, the straps are symmetrical from where the straps intersect under the user's cars. Further difficulty may be associated with adjusting the straps such that all of the straps are taut when the buckle is connected.

While conventional helmets may meet certain safety standards when the straps are adjusted correctly, very few users actually use their helmets in a correctly adjusted configuration. Also, many user's make necessary adjustments to the straps while the helmet is off the user's head, which may result in the process being completed by trial and error. Typically, even with several adjustment attempts, when the buckle is connected, at least one of the straps (e.g., in front of or in back of cars) will be loose, which could allow the helmet to become dislodged in the event of a crash. Furthermore, adjustment may be so cumbersome that few users are willing to adjust their chin strap to be as tight as it should be because a requisite level of tightness may not be comfortable and much of the time, the user may not be engaging in the most dangerous part of their activity which would require a tight strap. Therefore, most users end up wearing their helmet with the straps being uneven and too loose, even when they know they may engage in the most dangerous part of their activity. Undoubtedly, such improper fitting of conventional straps may cause a significant number of head trauma injuries, and in some cases, deaths.

When conventional straps are not adjusted properly, the straps may not always prevent undesirable pivotal movement of the helmet toward the front or rear of the wearer's head. This potential pivotal movement may result in exposing the back or front of the wearer's head, which may be hazardous especially during a multiple-impact fall.

For a helmet to properly protect a user's head, it is typically critical that the chin strap be properly adjusted. However, when properly adjusted, the snug chin strap may not be comfortable and so many users unbuckle their chin strap during times of use that are not as dangerous. For example, while riding a ski lift, a ski or snowboard helmet may not be necessary for safety and so many users will unbuckle their chin strap for the ski lift ride, and then buckle their chin strap prior to skiing. Understandably, users sometimes forget to buckle their straps, which is dangerous and could lead to their helmet falling off of their head.

Accordingly, there is a need in the art for a helmet retention system that is easy to adjust to a proper retention position, without creating discomfort to the user. Various aspects of the present disclosure address this particular need, as will be discussed in more detail below.

BRIEF SUMMARY

According to one embodiment, there is provided a helmet comprising a shell having a front portion, a rear portion, and a pair of lateral portions extending between the front portion and the rear portion. The shell is sized and configured to be placeable on the head of a user. The helmet additionally includes a chin strap having a pair of end portions and an intermediate portion located between the pair of end portions. The end portions are fixedly connected to respective ones of the pair of lateral portions of the shell so as to restrict movement of the end portions relative to the shell. The chin strap is flexible to facilitate placement of the chin strap around a chin of a user in connection with placement of the shell on the head of the user.

The shell and the chin strap may collectively define a continuous loop configured to remain intact while the shell is placed on the head of the user and the chin strap is placed around the chin of the user.

The chin strap may define a length as a distance along the chin strap between the end portions, with the chin strap being configured to facilitate selective adjustment of the length.

The chin strap and helmet may be configured such that when the helmet is worn by the user the pair of end portions extend adjacent only one side of a respective one of a pair of cars of the user.

The shell may include a main body having a lower peripheral edge, and a pair of strap mounts coupled to the main body in spaced relation to each other and extending from the lower peripheral edge. The pair of end portions of the strap may be fixedly connected to respective ones of the pair of strap mounts. Each strap mount may be detachably connected to the main body. The strap may include a pair of segments, with each segment being connected to a respective one of the pair of strap mounts and the segments being configured to be detachably engageable with each other. Each segment may include a portion fabricated from woven material. The helmet may also include a pair of connectors coupled to respective ones of the pair of segments. The pair of connectors may be cooperatively engageable with each other to facilitate connection of the pair of segments together.

The shell may include a mouth-guard portion extending below the front portion and between the pair of lateral portions.

The chin strap may have internal strength to retain a prescribed shape unless acted on by an outside force that is above a desired magnitude.

According to another embodiment, there is provided a helmet comprising a shell having a front portion, a rear portion, a pair of lateral portions extending between the front portion and the rear portion, and a pair of strap attachment portions located at respective ones of the pair of lateral portions. The shell is sized and configured to be placeable on the head of a user. The helmet additionally includes a chin strap having a pair of end portions and an intermediate portion located between the pair of end portions. At least one of the pair of end portions is fixedly connected to a respective one of the pair of strap attachment portions so as to restrict movement at least one of the pair of end portions relative to the shell.

The helmet may include a pair of connectors configured to be engageable with the strap, with the pair of connectors being detachably engageable with each other.

One of the pair of connectors may be connected to the strap and the other of the pair of connectors being connectable to the shell at the strap attachment portion.

The shell may include a main body having a lower peripheral edge, and a pair of strap mounts coupled to the main body in spaced relation to each other and extending from the lower peripheral edge, with the pair of strap mounts defining the pair of strap attachment portions. Each strap mount may be detachably connected to the main body.

According to another embodiment, there is provided a helmet comprising a shell sized and configured to be placeable on the head of a user. The helmet additionally includes a chin strap coupled to the shell, with the chin strap being formed from a semi-rigid material and having at least two segments moveable relative to each other. The chin strap includes two attachment portions, with the chin strap being connectable to the shell at the two attachment portions. The chin strap defines a length as the distance along the chin strap between the two attachment portions. The chin strap is configured to be selectively transitional between a lengthened configuration and a tightened configuration, with the length decreasing as the chin strap transitions from the lengthened configuration toward the tightened configuration.

The helmet may include a spring coupled to the segments to bias the chin strap toward the lengthened configuration. The helmet may also include a cable extending between the segments to facilitate movement of the segments relative to each other. The cable may be configured to facilitate application of a force to two segments that overcomes the spring to transition the two segments toward the tightened configuration.

The helmet may also include a dial coupled to the cable to facilitate movement of the cable relative to at least one of the segments. The dial may be coupled to the shell or coupled to the chin strap.

The chin strap may include a pair of lateral segments and a center segment extending between the pair of lateral segments and being moveable relative to lateral segments.

The chin strap may be fixedly coupled to the shell at one of the two attachment portions, and moveably coupled to the shell at the other one of the two attachment portions. The chin strap may include a toothed segment, with the helmet further comprising a dial engageable with the toothed segment to facilitate movement of the chin strap relative to the shell.

The chin strap may be pivotable relative to shell.

The shell may include a main body having a lower peripheral edge, and a pair of strap mounts coupled to the main body in spaced relation to each other and extending from the lower peripheral edge. The chin strap may be coupled to the shell at the pair of strap mounts.

According to another embodiment, there is provided a helmet comprising a shell sized and configured to be placeable on the head of a user. The helmet additionally includes a chin strap coupled to the shell, with the chin strap being formed from a semi-rigid material. The helmet further includes a head support coupled to the shell and having at least two support bodies. The head support is transitional being an expanded configuration and a retracted configuration, with portions of the at least two support bodies moving toward each other as the head support transitions from the expanded configuration to the retracted configuration.

The chin strap may be configured to be extendable between a lengthen configuration and a tightened configuration, with a length of the chin strap decreasing as the chins trap transitions from the lengthened configuration toward the tightened configuration. The chin strap and the head support may be operatively coupled to each other to facilitate simultaneous adjustment of both the chin strap and the head support. The helmet may additionally include a dial in operative communication with the chin strap and the head support to facilitate simultaneous adjustment of both the chin strap and the head support. The helmet may include a cable interconnecting the dial to the head support and the chin strap.

The head support may include a rear support member and a front support member operatively connected to the rear support member.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
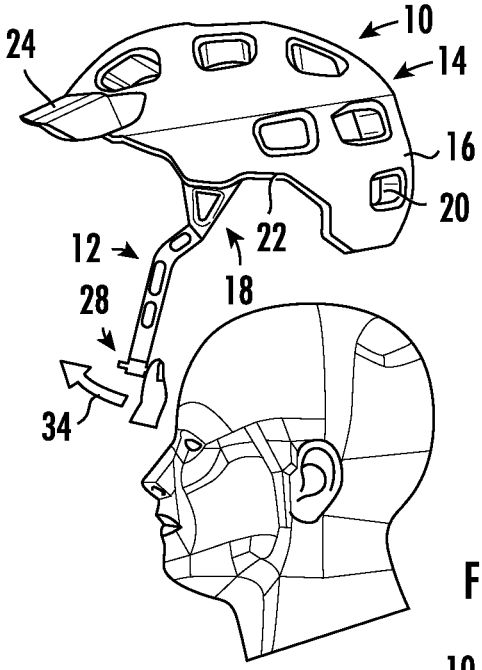
FIG. 1 is a side view of a first embodiment of a helmet with non-pivotable chin strap located above a head of a user.

The detailed description set forth below in connection with the appended drawings is intended as a description of certain embodiments of a retention mechanism for a helmet and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the drawings are for purposes of illustrating a preferred embodiment of the present invention only, and are not for purposes of limiting the same, FIGS. 1-12 depict a first embodiment of a helmet 10 having an easy-to-use, comfortable chin strap 12. The helmet 10 generally includes a shell 14 coupled to the chin strap 12, with the shell 14 including a main body 16 and a pair of strap mounts 18 coupled to the main body 16. The main body 16 includes an inner surface defining a cavity sized to receive at least a portion of the head of the user. An exposed outer surface is opposite the inner surface and one or more openings 20 may extend between the inner and outer surfaces to enhance ventilation and reduce the overall weight of the helmet 10. The main body 16 may also include a front portion, a crown portion, a rear portion, and a pair of lateral portions extending between the front and rear portions and below the crown portion. The main body 16 further includes a lower peripheral edge 22 extending around the main body 16 across the front portion, the lateral portions and the rear portion. The main body 16 may be sized such that the lower peripheral edge 22 extends over the user's forehead, across the user's temples, over and around the user's ears, and across the back of the user's head, slightly above where the user's head connects with the user's neck. In this regard, the lower peripheral edge 22 may be non-linear to correspond to the anatomy of the wearer. The main body 16 may be fabricated from foam, plastic, or other materials known in the art, which may be lightweight, but also capable of absorbing impacts to protect the user's head.

The pair of strap mounts 18 may be connected to the main body 16 and may extend from the main body 16 below the lower peripheral edge 22 from the area where the strap mounts 18 extend. In this regard, other portions of the lower peripheral edge 22 may extend below the strap mounts 18, particularly at the rear portion of the helmet 10. However, the strap mounts 18 extend below the lower peripheral edge 22 at the lateral portions of the helmet 10.

The strap mounts 18 are arranged on opposite sides of the main body 16 in generally opposed relation to each other. When the helmet 10 is worn, the strap mounts 18 may be located in front of the user's ears in general proximity to where sideburns may extend on a wearer. In one embodiment, the strap mounts 18 include a tapered configuration, with a wider portion adjacent the main body 16 to provide for a more robust interconnection between the strap mounts 18 and the main body 16, and a narrower portion extending away from the main body 16. In the example depicted in FIGS. 1-12, the strap mounts 18 are of a generally triangular configuration, with the apex of the triangle pointing away from the main body 16. The strap mount 18 depicted in FIGS. 1-12 includes a forward edge that includes two linear segments angularly offset from each other, with a distal-most segment being angled to correspond to the attachment of the chin strap 12 thereto, as will be described in more detail below.

The helmet 10 may additionally include a visor 24 defining a pocket recess. For more information regarding the visor and potential uses thereof, please refer to U.S. Pat. No. 11,089,831, entitled INCREMENTALLY ADJUSTABLE AND PIVOTABLE SEMI-RIGID RETENTION STRAP FOR A HELMET, the contents of which are expressly incorporated herein by reference.

The chin strap 12 may include a pair of strap arms 26, each having a respective upper end portion configured to be fixedly attached to the strap mounts 18. According to one embodiment, each strap arm 26 may be made from a semi-rigid material, such as injection molded Nylon, Pebax®, or other equivalent materials known in the art capable of being flexed. In this regard, at least the strap arms 26 may be disposable in both tension and compression. Thus, the strap arms 26 differ from conventional woven chin straps, which are generally incapable of being disposed in compression. The strap arms 26 may be attached to the strap mounts 18 via adhesives, rivets, or other mechanical fasteners in the art. It is also contemplated that the strap arms 26 and the strap mounts 18 may be molded together, with each strap arm 26 and strap mount 18 forming a single integral structure, although the thickness of the strap arm 26 may be less than that of the strap mount 18 to allow for greater flexibility of the strap arm 26.

The lower end portions of the strap arms 26 may be connected via a twist adjustment mechanism 28 with a twisting adjustment knob 30, and a pad 32. In more detail, lower end portions of the strap arms 26 may be coupled to the twist adjustment mechanism 28 in a manner which allows for movement of the lower end portions of the strap arms 26 relative to each other. Turning of the twisting adjustment knob 30 in a first direction may move the lower end portions of the strap arms 26 toward each other to facilitate selective tightening of the chin strap 12, while turning of the twisting adjustment knob 30 in an opposite second direction may move the lower end portions of the strap arms 26 away from each other to facilitate selective lengthening of the chin strap 12.

The upper end portions of the chin strap 12 may be fixedly connected (e.g., non-pivotally connected) to the strap mounts 18 such that at least one point or area on the upper end portions of the chin strap 12 remains fixed relative to the strap mounts 18, while the remainder of the strap arms 26 may be flexed relative to the strap mount 18. In this respect, a pivoting joint may not be required between strap mount 18 and the chin strap 12, which may allow for reduced manufacturing costs relative to pivoting chin strap embodiments. The upper end portions of the strap arms 26 may be fixed to the strap mounts 18 via a rivet, adhesive, or with other fixed attachment mechanisms known by those skilled in the art. It is also contemplated that the strap arms 26 may be molded as part of the strap mount 18, and thus, may form a single, integrated unit.

The fixed connection between the chin strap 12 and the shell 14 results in the chin strap 12 and shell 14 defining a continuous loop that remains intact during use of the helmet 10. The shell 14 defines an upper portion of the loop while the chin strap 12 defines a lower portion of the loop. The continuous loop configuration is a departure from conventional helmets that include a buckle connector in the middle of the strap that is disconnected to break the loop when removing the helmet from the user's head.

According to one embodiment, the location of the attachment point between the chin strap 12 and the shell 14 falls within an attachment zone 36, which may be strategically positioned to cause the chin strap 12 to tighten when the shell 14 is rotated forwards or backwards so that helmet 10 stays firmly on the user's head. For more information regarding the attachment zone 36 (also referred to as a location zone), please refer to U.S. Pat. No. 11,089,831, entitled INCREMENTALLY ADJUSTABLE AND PIVOTABLE SEMI-RIGID RETENTION STRAP FOR A HELMET, the contents of which are expressly incorporated herein by reference.

Furthermore, the configuration of the chin strap 12, the strap mounts 18 and the main body 16 allows for the chin strap 12 to extend adjacent only one side of the user's ear, i.e., in front of the user's ear, without having to extend adjacent both sides of the user's ear. This is a significant departure from conventional chin straps, which typically include two segments that extend in front of the user's ear, as well as behind the user's ear, which creates complications when adjusting, and may also result in discomfort during use.

Figure 2:
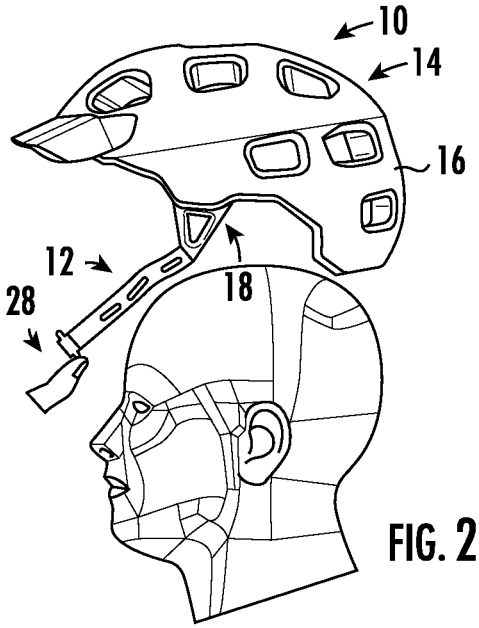
FIGS. 2-4 are side views of the helmet of FIG. 1 depicting placement of a helmet shell on the head of the wearer and flexing of the chin strap to avoid interference with the face of the user.

FIGS. 1-6 depict sequential placement of the helmet 10 on the user's head. As shown in FIG. 1, the main body 16 of shell 14 is oriented with the visor 24 pointing forward, and the top of the crown defining a tangential plane that is generally horizontal. The chin strap 12 extends downwardly from the main body 16 toward the head of the user. The user then urges the chin strap 12 forwardly and upwardly in the direction of arrow 34 shown in FIG. 1 to provide sufficient clearance. The chin strap 12 is flexed by a certain amount to provide sufficient clearance around the user's face, particularly around the user's nose. FIG. 1 shows the chin strap 12 in a neutral state, while FIG. 2 shows the chin strap 12 in a flexed state, wherein the lower end of the chin strap 12 has been flexed upwardly and forwardly toward the visor 24 or front portion of the shell 14. When in the flexed state, a forward edge of the chin strap 12 may be disposed in compression, while an opposing rearward edge of the chin strap 12 may be disposed in tension.

Figure 3:
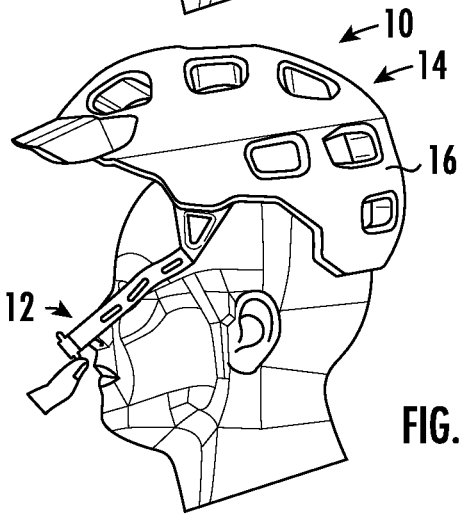
Figure 4:
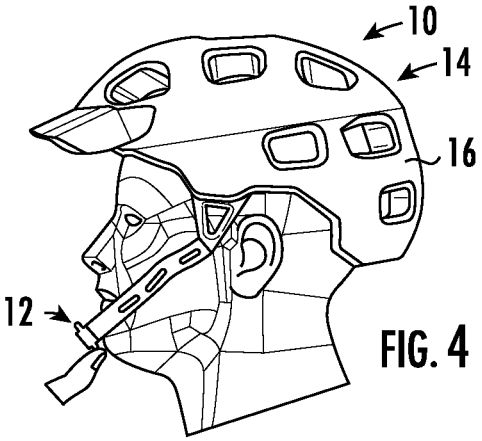
Figure 5:
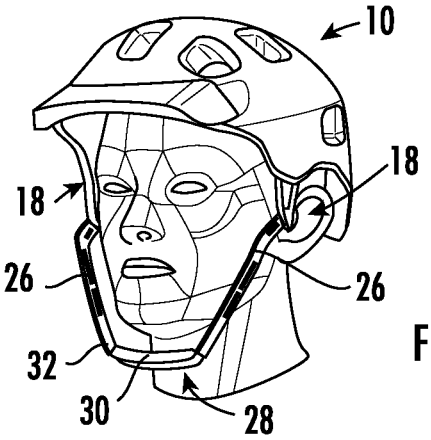
FIG. 5 is an upper perspective view of the helmet of FIG. 1 on the head of the user and the chin strap in a lengthened configuration.
Figure 6:
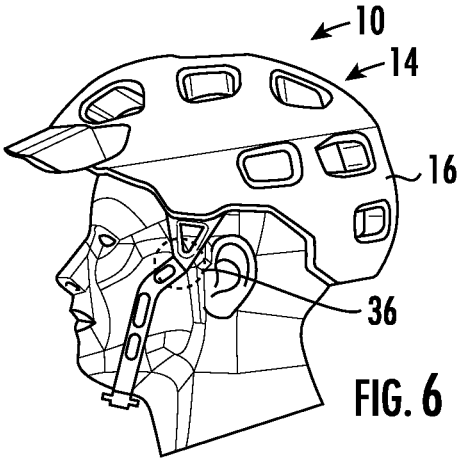
FIG. 6 is a side view of the helmet of FIG. 1 on the head of the user and the chin strap in a tightened configuration.

While the chin strap 12 is flexed, the main body 16 of the shell 14 is lowered onto the user's head, as can be seen in FIGS. 2-4. Once the main body 16 is resting on the user's head, the strap 12 may be carefully released to allow the strap 12 to return to its neutral position, which will cause the strap 12 to extend under the user's chin. The strap 12 may have material characteristics which result in the strap 12 being biased toward the neutral position due to an internal biasing force. Once the strap 12 is in the neutral position under the user's chin, the chin strap 12 may be tightened using the adjustment knob 30, as described above.

Figure 7:
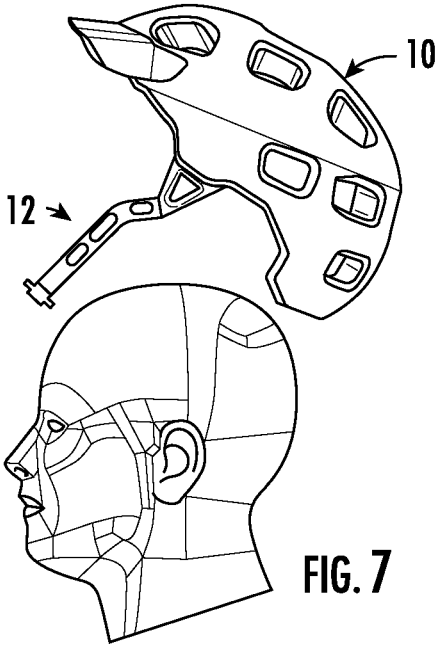
FIGS. 7-12 illustrate sequential placement of the helmet of FIG. 1 on the head of the user without flexing the chin strap, and instead, by tilting the helmet rearwardly to angle the chin strap away from the face of the user.
Figure 8:
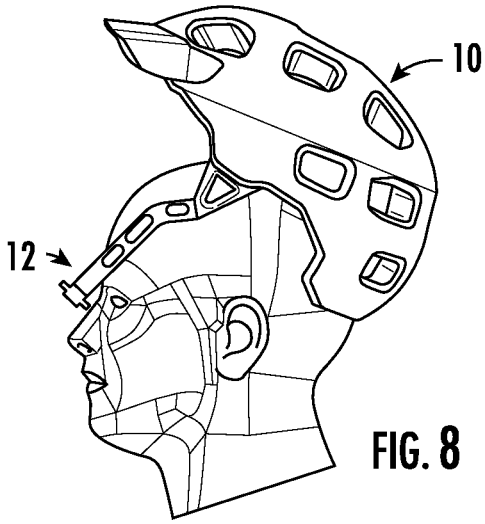
Figure 9:
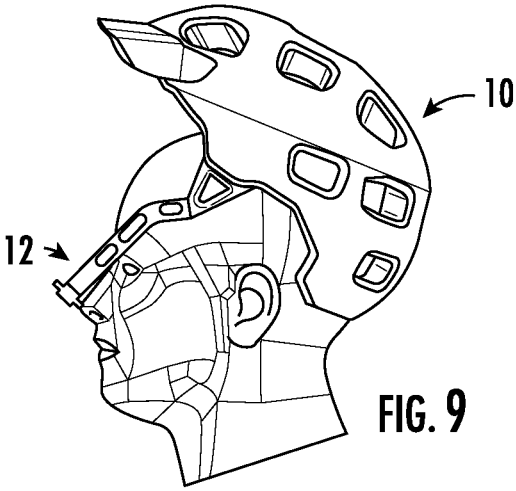
Figure 10:
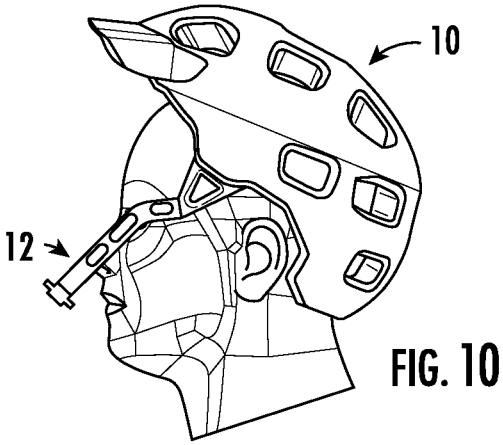
Figure 11:
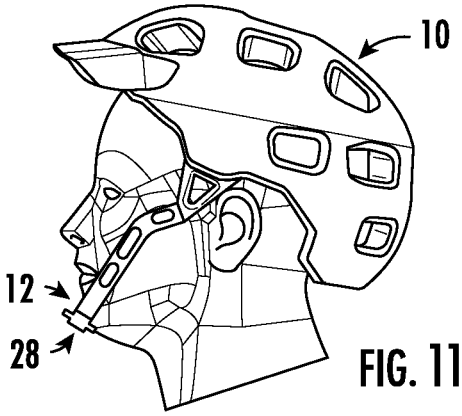
Figure 12:
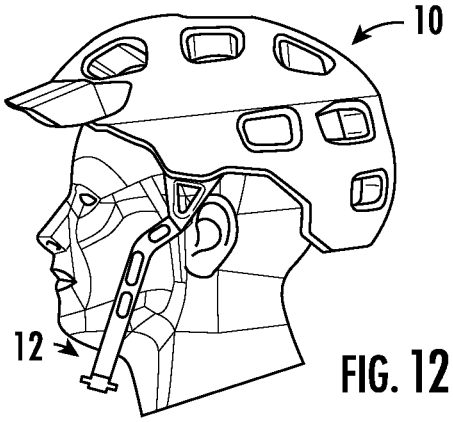
Figure 13:
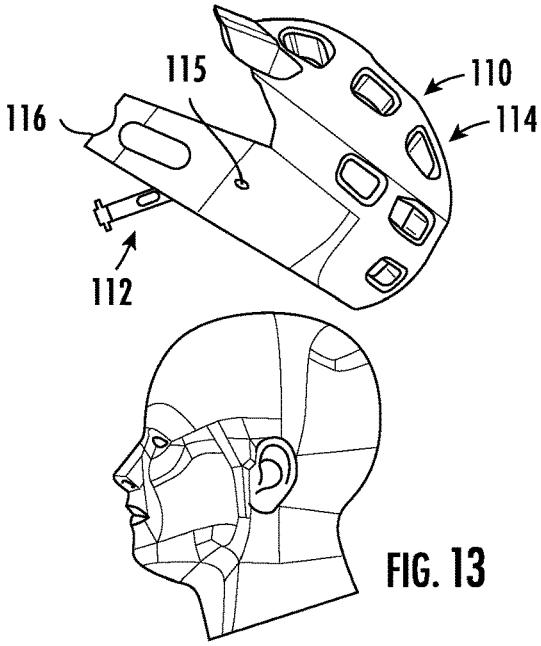
FIGS. 13-19 illustrate sequential placement of a full-face helmet having a chin strap on a head of a user, wherein the helmet is rotated in a rearward direction to provide clearance between the chin strap and the face of the user.
Figure 14:
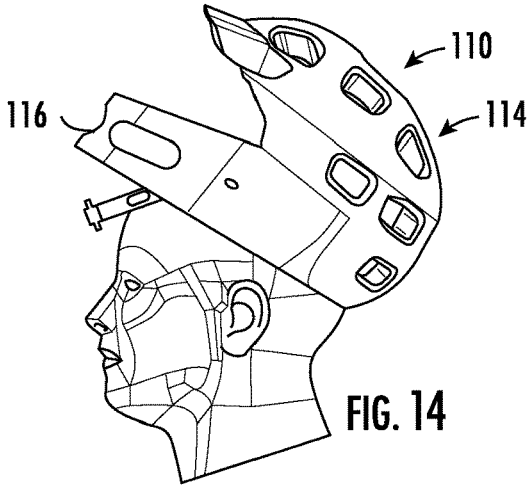
Figure 15:
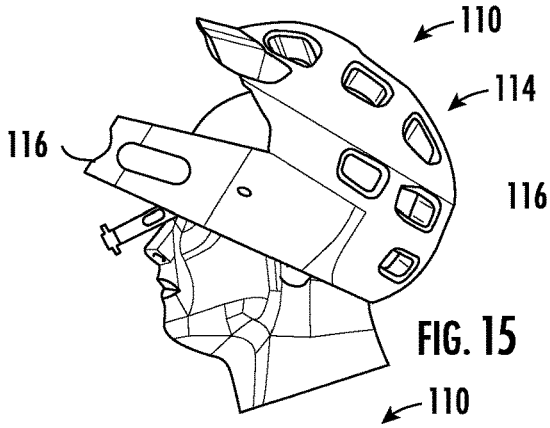
Figure 16:
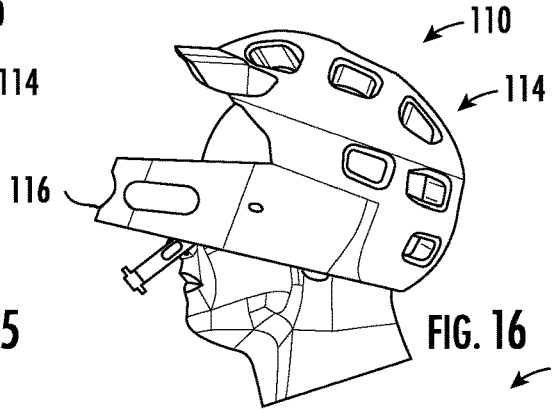
Figure 17:
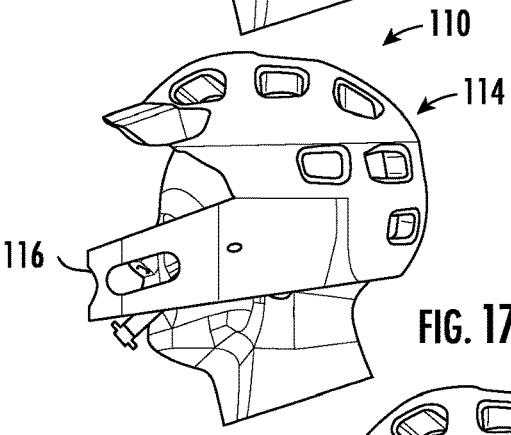
Figure 18:
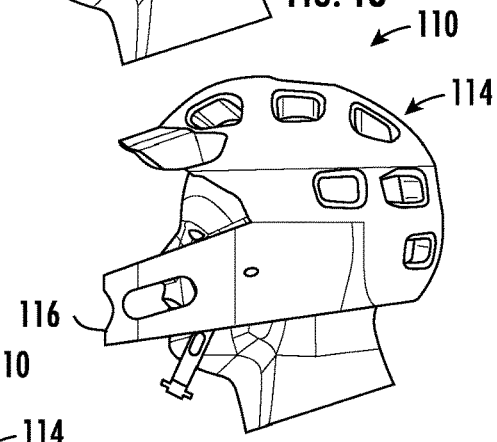
Figure 19:
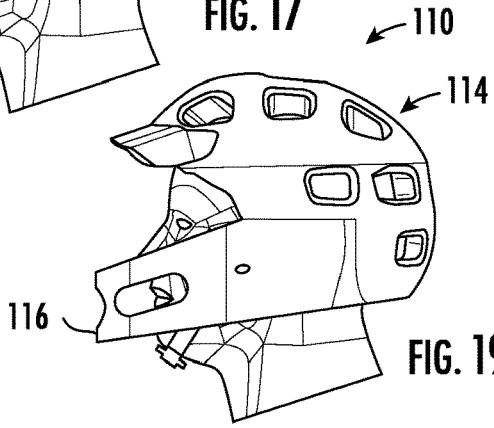
Figure 20:
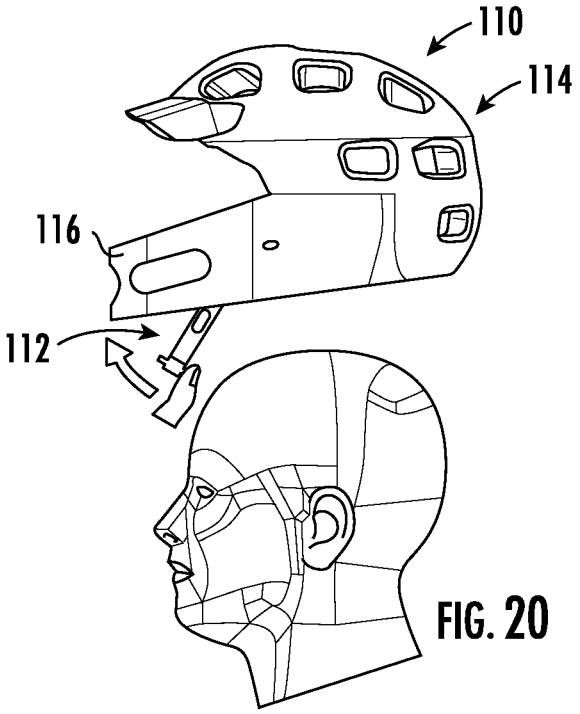
FIGS. 20-25 illustrate sequential placement of the full-face helmet of FIGS. 13-19 on the head of the user, wherein the chin strap is flexed to provide clearance between the chin strap and the face of the user.
Figure 21:
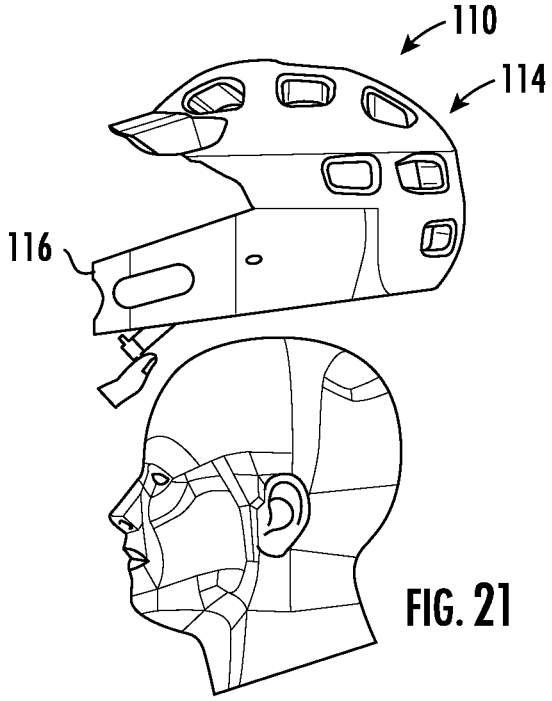
Figure 22:
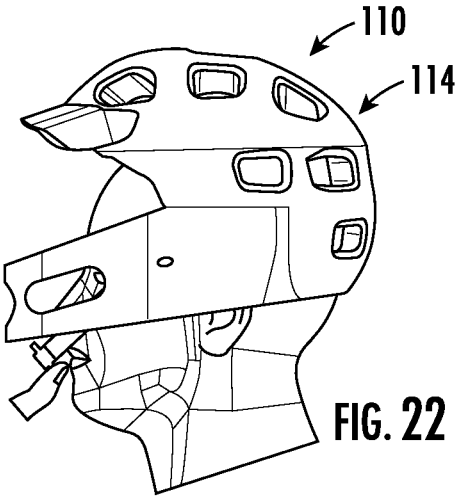
Figure 23:
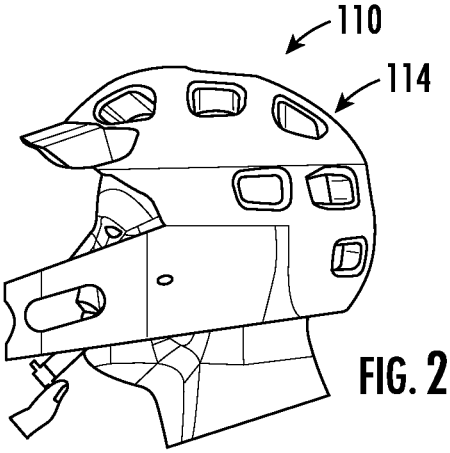
Figure 24:
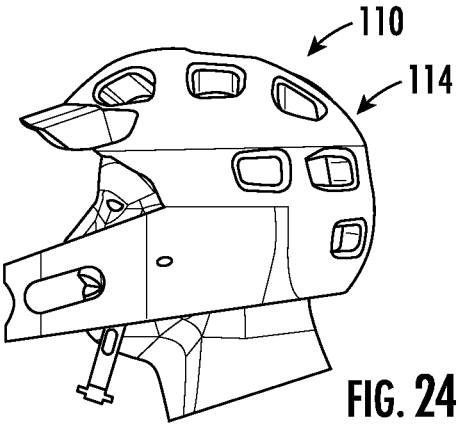
Figure 25:
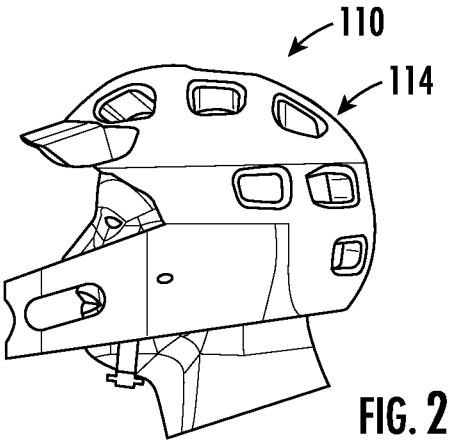
Figure 26:
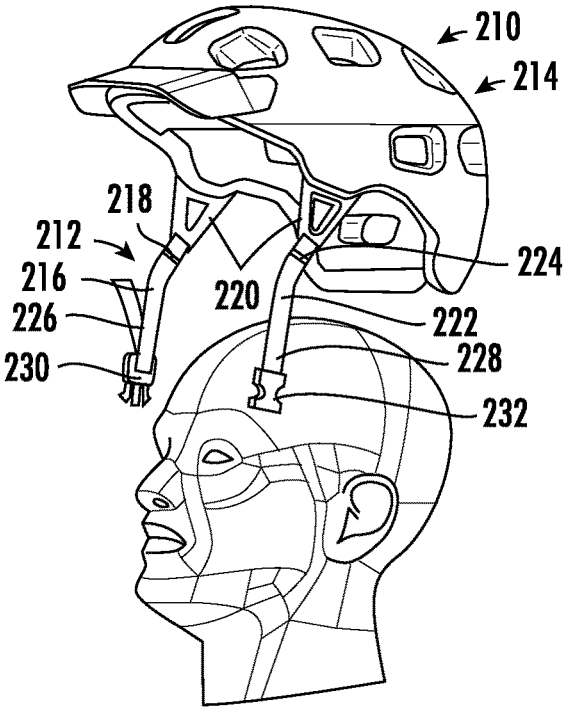
FIG. 26 is a perspective view of another embodiment of a helmet having a pair of webbing strap segments extending from respective strap mounts located below a lower edge of a helmet shell, the helmet being positioned above a head of a user.
Figure 27:
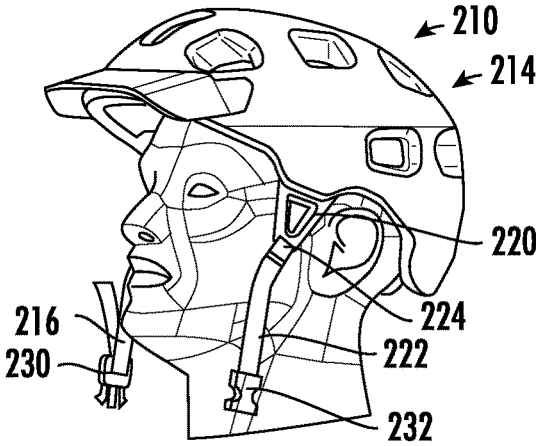
FIG. 27 is a perspective view of the helmet of FIG. 26, with the helmet shell resting on the head of the user and the strap segments disconnected from each other.
Figure 28:
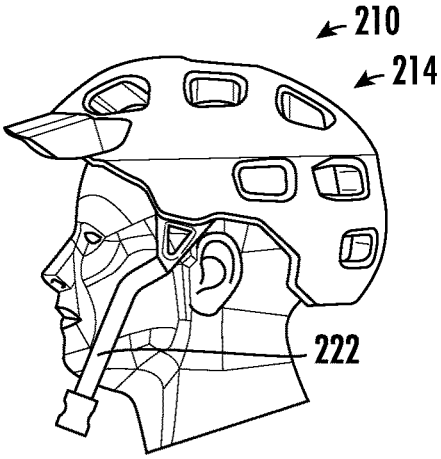
FIG. 28 is a side view of the helmet of FIG. 27.
Figure 29:
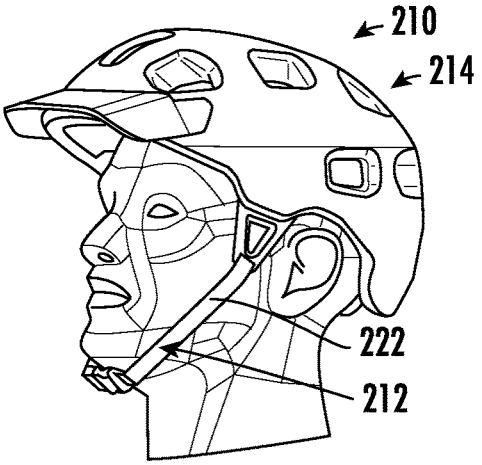
FIG. 29 is a perspective view of the helmet of FIG. 27, with the strap segments connected to each other.
Figure 30:
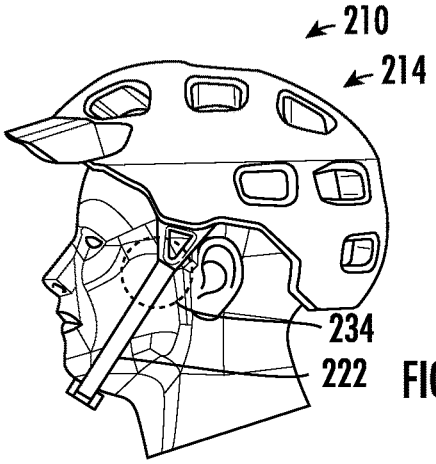
FIG. 30 is a side view of the helmet of FIG. 29.

Referring now to FIGS. 7-12, there is depicted another technique for placement of the helmet 10 on the user's head without flexing the chin strap 12. In this regard, the technique depicted in FIGS. 7-12 may allow for use of a chin strap 12 that is more rigid than the chin strap 12 used for placement on the user's head in the manner depicted in FIGS. 1-6. As shown in FIG. 7, the main body 16 of shell 14 is oriented with the visor 24 pointing upwardly, and the top of the crown defining a tangential plane that is angled upwardly, preferably between 5°-65° relative to the horizontal. Angling the main body 16 in this manner aligns the opening defined by the chin strap 12 and the main body 16 with the user's head, with the chin strap 12 extending forwardly in front of the user's face so as to avoid contact with the user's face. The main body 16 of the shell 14 is then lowered toward the user's head, with the helmet 10 maintaining the angled configuration, as shown in FIGS. 8-10. Once the helmet 10 is placed on the user's head, the helmet 10 may be rotated to bring the chin strap 12 under the user's chin, as can be seen in FIGS. 10-12.

Referring now to FIGS. 13-25, there is depicted another embodiment of a helmet 110 including a full-face shell 114. The helmet 110 includes a chin strap 112 coupled to the full-face shell 114 via rivets 115, or other mechanical attachment mechanisms known in the art. The chin strap 112 is similar to the chin strap 12 described above. In this regard, the primary distinction between the embodiment depicted in FIGS. 13-25 and the embodiment depicted in FIG. 1-12 is the configuration of the shell 114. The full-face shell 114 includes a front portion, a crown portion, a rear portion, and a pair of lateral portions extending between the front and rear portions and below the crown portion. The full-face shell 114 also includes a lower face guard 116 (e.g., mouthguard portion) extending from one lateral portion of the shell 114 to another lateral portion of the shell 114 opposite the rear portion. When the helmet 110 is worn by the user, the lower face guard 116 extends over the mouth of the user.

The helmet 110 shown in FIGS. 13-25 may be placed on the user in the same manner as the helmet 10 depicted in FIGS. 1-12. In other words, the helmet 110 may be placed on the user's head by tilting the helmet 110, as shown in FIGS. 13-19, or by flexing the chin strap 112, as shown in FIGS. 20-25.

Referring now to FIGS. 26-30, there is depicted another embodiment of the helmet 210 having a shell 214 and a chin strap 212 formed from a woven or webbing material, such as woven Nylon or other woven/webbing materials known in the art. The shell 214 is similar to the shell 14 discussed above, and thus, the following discussion will focus on the unique attributes of the chin strap 212.

The chin strap 212 includes a first segment 216 having a fixed end portion 218 fixedly coupled to a first one of the strap mounts 220 and a second segment 222 having a fixed end portion 224 fixedly attached to a second strap mount 220. The straps segments 216, 222 may be attached to the respective strap mounts 220, such as via sewing, welding, adhesives, hooks and loops fasteners (e.g., VELCRO™), or the like.

Each of the first and second segments 216, 222 may additionally include a free end portion 226, 228 opposite the fixed end portion 218, 224. Each free end portion 226, 228 may be coupled to a strap connector 230, 232, such that the strap connector 230 on the first segment 216 is cooperatively engageable with the strap connector 232 on the second segment 222. In one embodiment, the first and second strap connectors 230, 232 may be cooperatively engageable male and female buckles.

The length of the chin strap 212 may be defined as the distance along the strap 212 between the attachment portions of the strap mounts 220 when the first and second segments 216, 222 are coupled to each other via the strap connectors 230, 232. The strap connectors 230, 232 may be slidably connected to their respective strap segments 216, 222 to selectively increase or decrease the strap length.

The location where the strap segments 216, 222 attach to the respective strap mounts 220 may fall within a respective attachment zone 234, which is similar to the attachment zone 36 discussed above. In this regard, the attachment zone 234 is located such that the chin strap 212 is pulled tighter, or is disposed in tension, or increased tension, as the helmet 210 slides fore or aft on the user's head to inhibit the helmet 210 from being displaced from the user's head, or moved to a position which is no longer suitable for effectively protecting the user's head. The position of the attachment zone 234 allows each of the strap segments 216, 222 to extend only in front of the user's ear, without having any portion extending behind the user's ear. Thus, adjustment of the strap does not require adjustment of strap portions on both sides of the user's ears. Furthermore, the location of the attachment zone 234 allows the strap 212 to secure the shell 214 to the user's head, while also preventing significant pivoting of the shell 214 during use. As such, when the strap 212 is properly tightened to the user, the shell 214 may provide protection to the front, back, and sides of the user's head.

Figure 31:
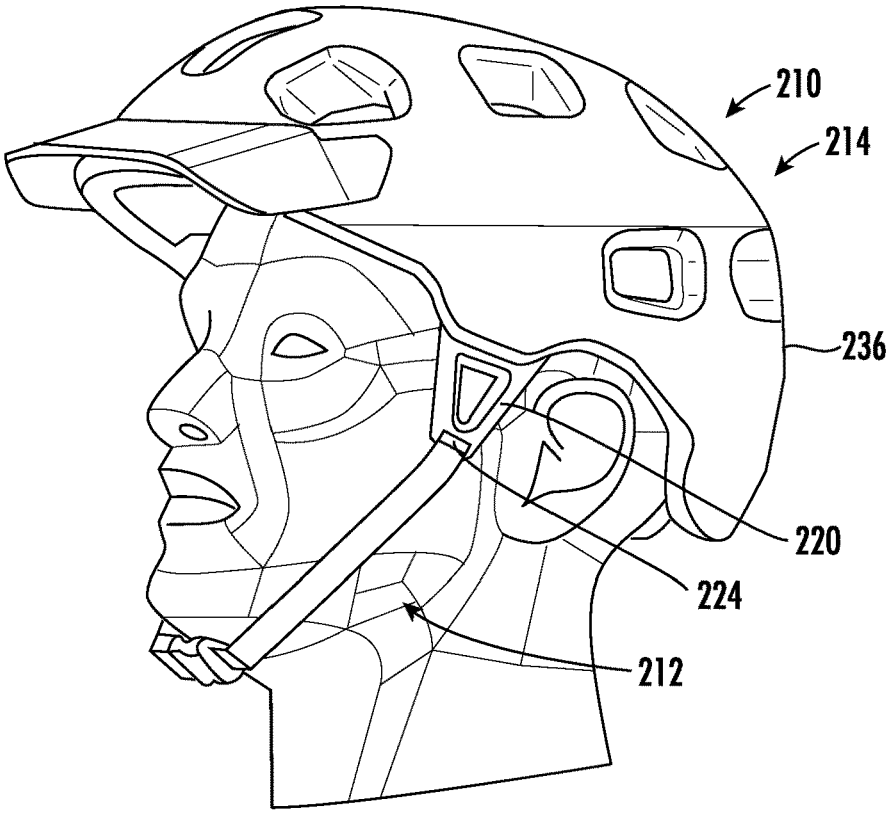
FIG. 31 is an enlarged view of FIG. 29.
Figure 32:
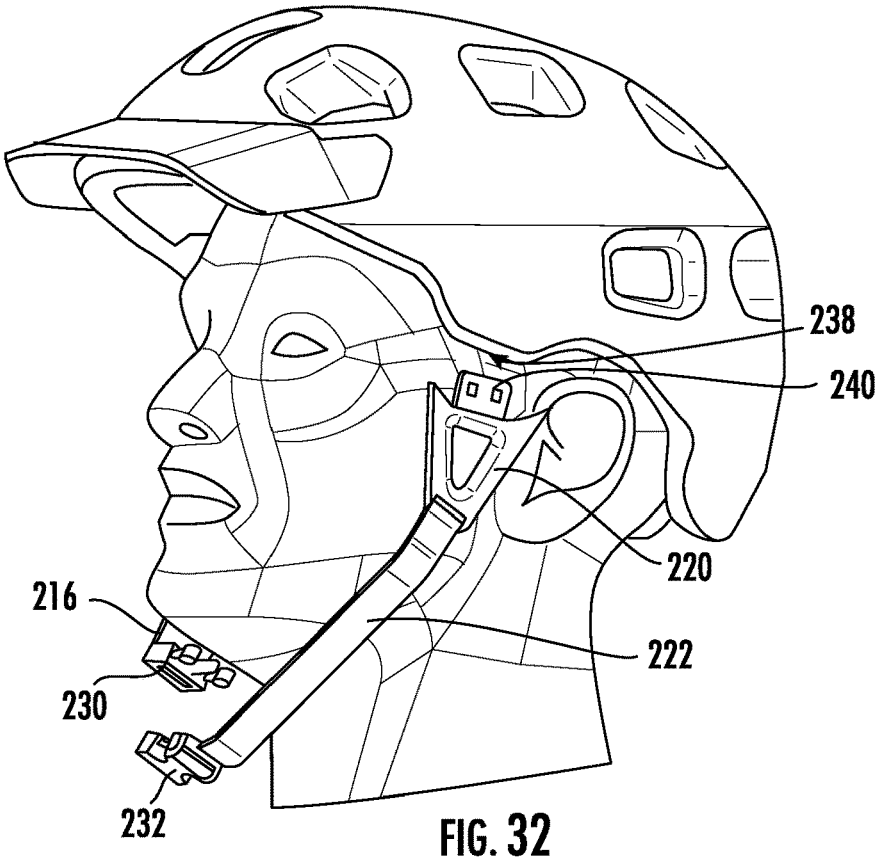
FIG. 32 is an enlarged perspective view of the helmet of FIG. 31, with the strap mount being disconnected from the helmet shell.
Figure 33:
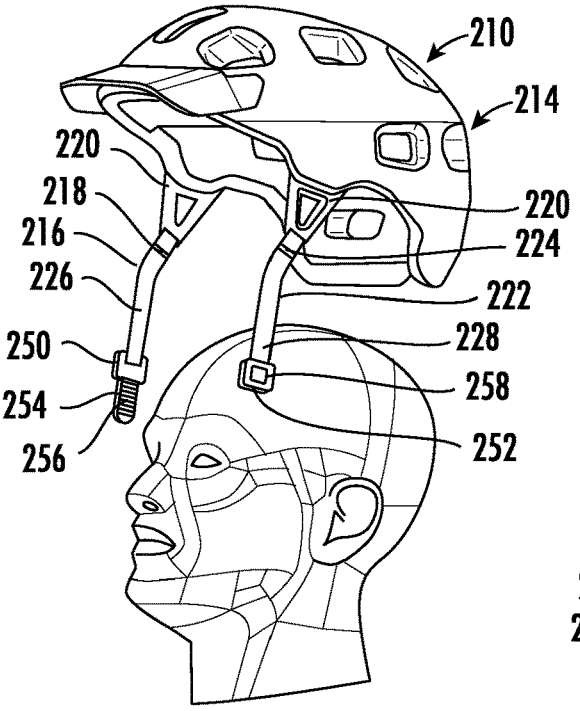
FIG. 33 is a perspective view of another embodiment of the helmet with a pair of webbing strap segments with a toothed buckle.
Figure 34:
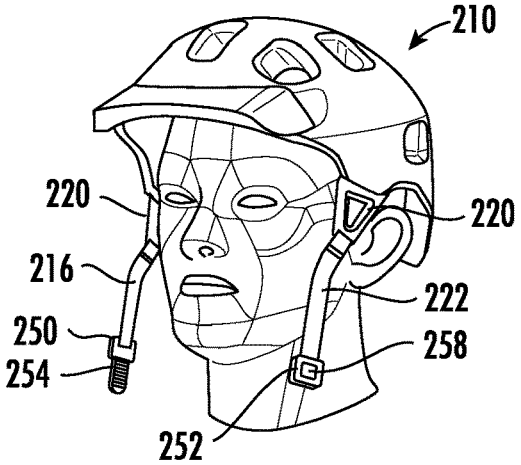
FIG. 34 is a perspective view of the helmet of FIG. 33, with the helmet shell resting on the head of the user and the strap segments disconnected from each other.
Figure 35:
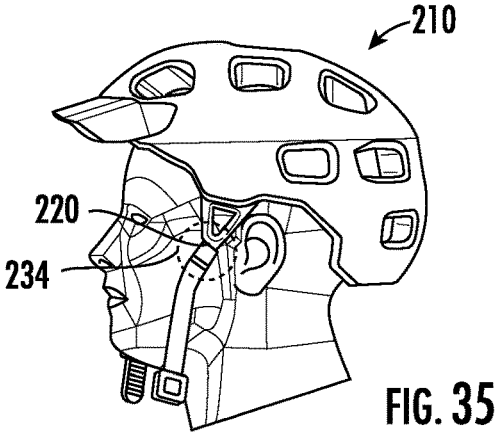
FIG. 35 is a side view of the helmet of FIG. 34.
Figure 36:
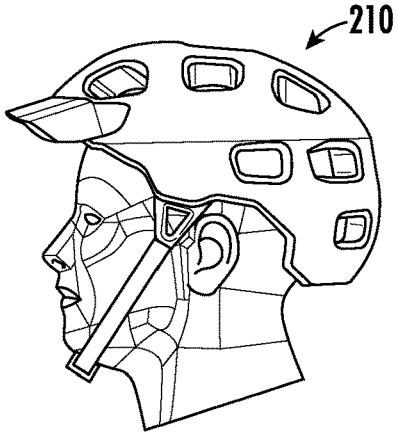
FIG. 36 is a side view of the helmet of FIG. 35, with the strap segments connected via the toothed buckle.
Figure 37:
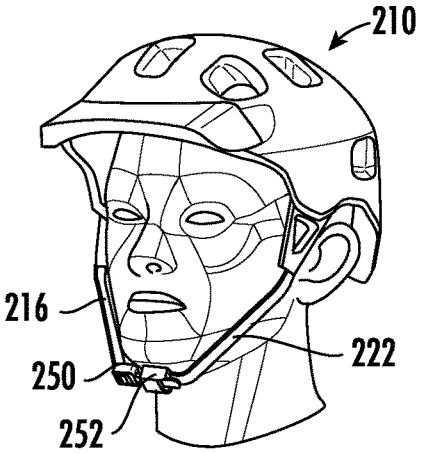
FIG. 37 is a perspective view of the helmet of FIG. 36.
Figure 38:
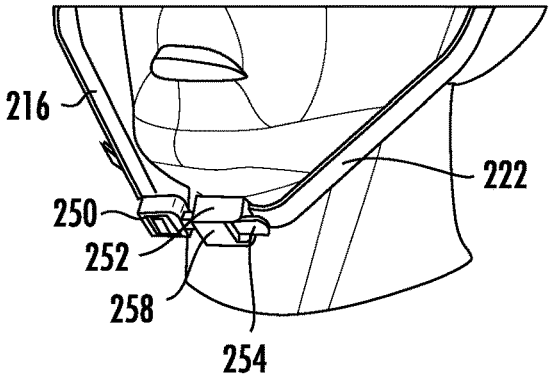
FIG. 38 is an enlarged perspective view depicting the toothed buckle included in the helmet of FIG. 37.
Figure 39:
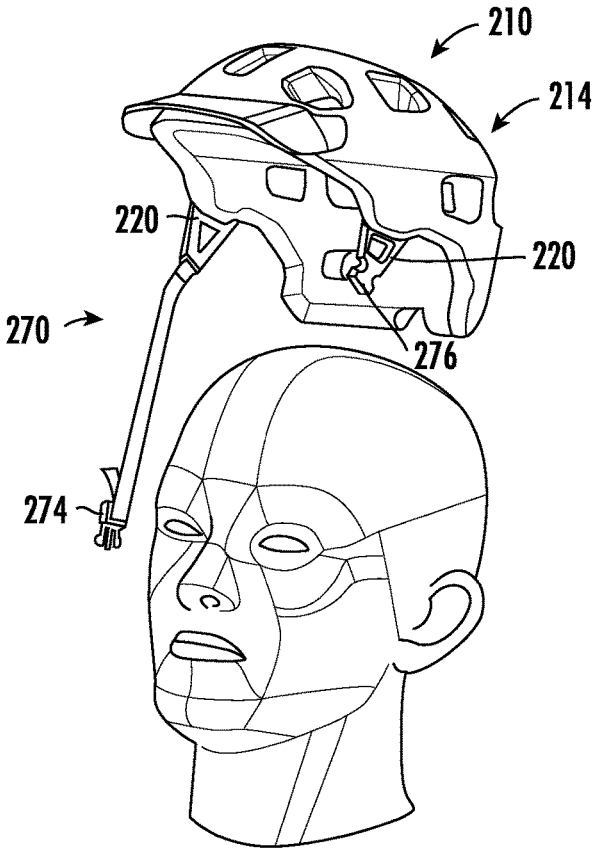
FIG. 39 is a perspective view of another embodiment of a helmet having a strap connected to one strap mount, and a strap connector connected to another strap mount, with the strap being disconnected to the strap connector.
Figure 40:
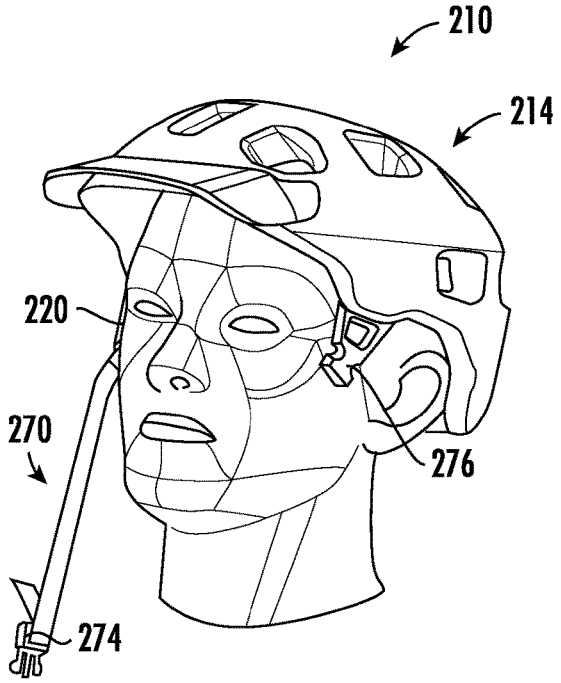
FIG. 40 is a perspective view of the helmet of FIG. 39.
Figure 41:
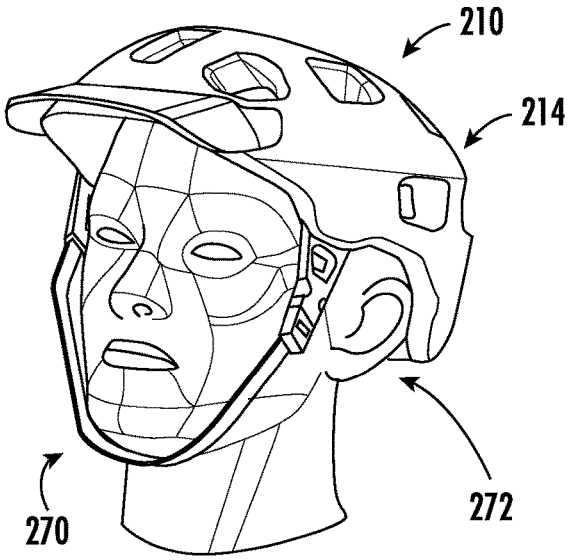
FIG. 41 is a perspective view of the helmet of FIG. 39, with the strap connected to the strap connector.
Figure 42:
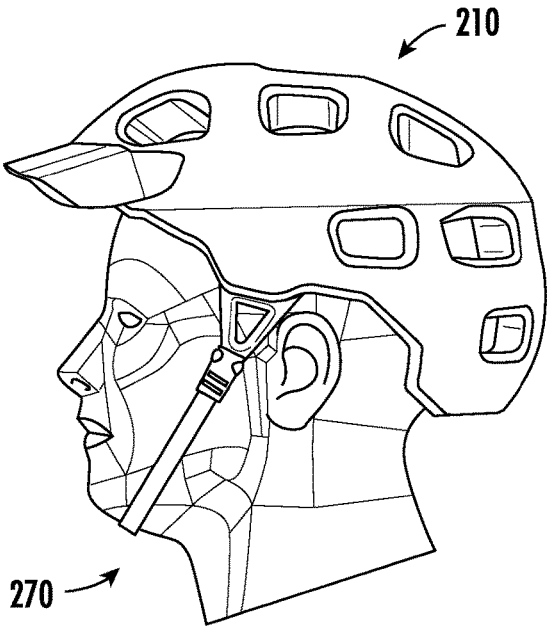
FIG. 42 is a side view of the helmet of FIG. 41.

Referring now to FIGS. 31 and 32, it is contemplated that one or both of the strap mounts 220 may be detachably connectable to the main body 236 of the shell 214. In this regard, the main body 236 may include a slot 238 that receives a corresponding fin 240 located on the detachable strap mount 220. Of course, the structure may be reversed, with the fin 240 extending from the main body 236 and the slot 238 is formed on the strap mount 220. In either case, the strap mount 220 and the main body 236 may include detachable engagement features that allow for selective attachment and detachment of the strap mount 220 relative to the main body 236 of the shell 214. The detachable engagement features (e.g., the fin 240 and corresponding slot 238) may be configured to facilitate sufficient engagement strength therebetween when the features are coupled to each other to prevent inadvertent detachment of the strap mount 220 from the main body 236 of the shell 214. For instance, the axis along which the fin 240 is received in the corresponding slot 238 may be offset from the angle at which the chin strap 212 is tensioned during normal use of the helmet 210 to prevent the tension from inadvertently pulling the strap mount 220 out of engagement with the main body 236 of the shell 214.

Referring now to FIGS. 33-38, there is depicted another implementation of chin strap connectors 250, 252 that may be used to secure the first and second segments 216, 222 to each other. The chin strap connectors 250, 252 include a ratchet-style buckle, with an elongate strip 254 having a plurality of teeth or serrations 256 that that is engageable with catch member 258, similar to the buckles used on conventional ski boots. In this regard, the length of the chin strap 212 may be adjusted by selectively adjusting the amount of the toothed strip 254 that is received within the catch member 258. The elongate nature of the strip 254 may accommodate length adjustability. In this regard, the chin strap length becomes shorter as more of the toothed strip 254 is advanced through the catch member 258, and conversely, the chin strap length is longer when more of the toothed strip 254 is not advanced through the catch member 258.

Referring now to FIGS. 39-42 illustrate another embodiment of the strap 270 and buckle 272, wherein the strap 270 includes a single strip of webbing material having one end portion coupled to a strap mount 220 and another end portion coupled to a strap connector 274. The other strap mount 220 is connected to the corresponding strap connector 276. In this regard, a key aspect of the embodiment depicted in FIGS. 39-42 is that the chin strap may include a single segment (as shown in FIGS. 39-42), or multiple segments (as shown in FIGS. 26-33), and that the one of the strap connectors may be attached directly to the strap mount 220.

Referring now to FIGS. 43-50, there is depicted another embodiment of a helmet 300 having a chin strap 302 which utilizes a filament or cable 304 to facilitate selective length adjustment of the chin strap 302. In more detail, the helmet 300 includes a shell 306 having a main body 308 and a pair of strap mounts 310, as described in more detail above. The chin strap 302 includes a pair of lateral segments 312 and an intermediate segment 314 extending between the pair of lateral segments 312. Each lateral segment 312 includes an attachment portion 316 that is connected to a respective strap mount 310. In the exemplary embodiment depicted in FIGS. 43-50, each attachment portion 316 may include an opening 318 formed at an end portion of the lateral segment 312. A boss 320 may extend around the opening 318 to facilitate engagement between the lateral segment 312 and the strap mount 310. The strap mounts 310 may include corresponding openings, which may be aligned with the openings 318 on the lateral segments 312 to facilitate engagement between the lateral segments 312 and the strap mounts 310. It is contemplated that the chin strap 302 may be configured to pivot relative to the strap mounts 310 between a lowered position under the user's chin, and a raised position, above the user's eyes, and tucked under the visor. However, it is understood that the scope of the present disclosure also includes a chin strap 302 that does not pivot relative to the strap mounts 310. Furthermore, it is contemplated that some embodiments of the helmet may include a visor, while other embodiments may not include a visor.

At least one, and preferably both, lateral segments 312 may also be configured to move relative to the intermediate segment 314 to facilitate overall length adjustment of the chin strap 302. Each lateral segment 312 may include a guide to direct movement of the intermediate segment 314 relative to the lateral segment 312. In the embodiment depicted in FIGS. 43-50, the guide includes a channel 322 formed in the lateral segment 312. In more detail, each lateral segment 312 may include an inner surface 324, an outer surface 326, an end face 328, with the guide channel 322 extending from the end face 328 into the lateral segment 312 between the inner and outer surfaces 324, 326. The guide channel 322 may be shaped to include a portion that is complementary to the configuration of the intermediate segment 314. The guide channel 322 may also be configured to accommodate a spring 330, which may be received within the guide channel 322 and may act on the lateral segment 312 and the intermediate segment 314 to bias the intermediate segment 314 toward a lengthened configuration, as will be explained in more detail below. As is apparent from at least FIG. 49, the spring 330 may be a helical-shaped spring.

The intermediate segment 314 includes a pair of end portions 332 and a middle portion 334 extending between the end portions 332. The intermediate segment 314 may also include an inner surface and an outer surface. Each end portion 332 is configured to be translatably received within a respective guide channel 322, and may include a pair of opposed edges and a cable guide 336 extending longitudinally along the end portion 332 between the pair of edges. In one embodiment, the cable guide 336 is a cylindrical structure extending outwardly from the outer surface. The middle portion 334 may include a curvature to accommodate the natural contours of a user's chin.

Although the exemplary embodiment shows a channel 322 formed in the lateral segment 312, within which the intermediate segment 314 may move, it is contemplated that the opposite configuration may also be used. In particular, the intermediate segment 314 may include one or more channels, within which the lateral segments 312 may move.

The lateral segments 312 and intermediate segment 314 may be formed from a semi-rigid material, such as a molded plastic, other polymers, rubber, or other materials known in the art. The semi-rigid nature of the material refers to the ability of the material to independently retain its shape, while also having the ability to be slightly flexed in response to a certain amount of force being applied thereto.

The cable 304 may operatively interconnect the lateral segments 312 and the intermediate segment 314 to facilitate selective positioning of the intermediate segment 314 relative to the lateral segments 312. The cable 304 may include one end 338 connected to a lateral segment 312 and another end connected to a dial 340, as will be explained in more detail below. In the cross sectional views depicted in FIGS. 46 and 49, the end 338 of the cable 304 is retained within a bore formed in the lateral segment 312 adjacent the opening 318. The cable 304 may be coupled to the lateral segment 312 via an adhesive, a rivet, molding, or other mechanical fastening techniques known in the art. The cable 304 may also be routed into the guide channel 322 on one lateral segment, through a first cable guide 336 on the intermediate segment 314, along an outer surface of the intermediate segment 314, through a second cable guide 336 on the intermediate segment 314, and through another guide channel 322 on another lateral segment 312, and then to the dial 340. The intermediate segment 314 may include a groove or other structure configured to retain the cable in place, adjacent the outer surface of the middle portion 334 of the intermediate segment 314. The cable 304 may be string, nylon filament, braided cable, or other suitable material that bends easily and exhibits sufficient pull strength.

The chin strap 302 may define a length as the distance along the chin strap 302 between the two attachment portions 316. In one embodiment, this measurement may be taken as a distance long the chin strap 302 between the axes about which the openings 318 are disposed. The chin strap 302 may be configured to be selectively transitional between a lengthened configuration and a tightened configuration, with the length decreasing as the chin strap 302 transitions from the lengthened configuration toward the tightened configuration, and the length increasing as the chin strap 302 transitions from the tightened configuration toward the lengthened configuration. In the embodiment depicted in FIGS. 43-50, when the chin strap 302 transitions from the lengthened configured toward the tightened configuration the degree to which the intermediate segment 314 is exposed decreases, and when the chin strap 302 transitions from the tightened configuration toward the lengthened configuration, the degree to which the intermediate segment 314 is exposed increases. In one particular embodiment, the chin strap 302 may be biased toward the lengthened configuration by the spring(s) 330, which may act on the lateral segments 312 and the intermediate segment 314 to push the lateral segments 312 away from the intermediate segment 314. Each spring 330 may extend between a spring retaining post 335 extending a respective end of the intermediate segment 314, and an abutment wall on a given lateral segment 312. The springs 330 may be configured to push the retaining post 335 away from the abutment wall on the lateral segment 312, which biases the chin strap 302 toward the lengthened configuration.

The user may be able to selectively transition the chin strap 302 between the lengthened configuration and the tightened configuration through the use of the cable 304. In this regard, the cable 304 may be configured to facilitate application of a force to the segments 312, 314 that overcomes the biasing force of the spring 330 to transition the segments 312, 314 toward the tightened configuration. The dial 340 may be coupled to the cable 304 to facilitate movement of the cable 304 relative to at least one of the segments 312, 314. An effective length of the cable 304 may be defined as the distance along the cable 304 between the dial 340 and bore within which the cable 304 is mounted; or the distance between the dial 340 and the end 338 of the cable 304.

The dial 340 may be mounted to the strap mount 310 via a dial connector 342 and may be operatively coupled to a reel about which the cable 304 may be wound during tightening of the chin strap 302, and from which the cable 304 may be released during lengthening of the chin strap 302. In one embodiment, the dial 340 is axially moveable relative to the strap mount 310 between a locked position and an unlocked position. In other words, the dial 340 may be pushed toward the shell 306 or pulled away from the shell 306 as it transitions between the locked and unlocked positions. When the dial 340 is in the unlocked position, the dial 340 may not restrict movement of the cable 340, which allows the springs 330 to transition the chin strap 302 to its lengthened configuration. When the dial 340 is in the locked position, the dial 340 may restrict lengthening of the cable 302, while allowing for shortening of the cable 302. In this regard, the dial 340 may be allowed to rotate in a prescribed direction to allow for shortening of the cable 302 to selectively adjust the size of the chins strap 302, so long as the dial 340 remains in the locked position. The chin strap 302 may remain in the tightened configuration until the user wants to lengthen the chin strap 302, which may be done by moving the dial from the locked position toward the unlocked position. Once the dial 340 has been moved to the unlocked position, the springs 330 may urge the segments 312, 314 away from each other to automatically transition the chin strap 302 to the lengthened configuration. In this regard, the chin strap 302 may not require rotation of the dial 340 to transition from the tightened configuration to the lengthened configuration. Rather, all that may be needed is to move the dial 340 from the locked position to unlocked position (e.g., pulling the dial 340 out, or pushing the dial 340 in).

In another embodiment, the dial 340 may be configured to be turned in opposite directions to facilitate either lengthening or shortening of the cable 304.

Figure 43:
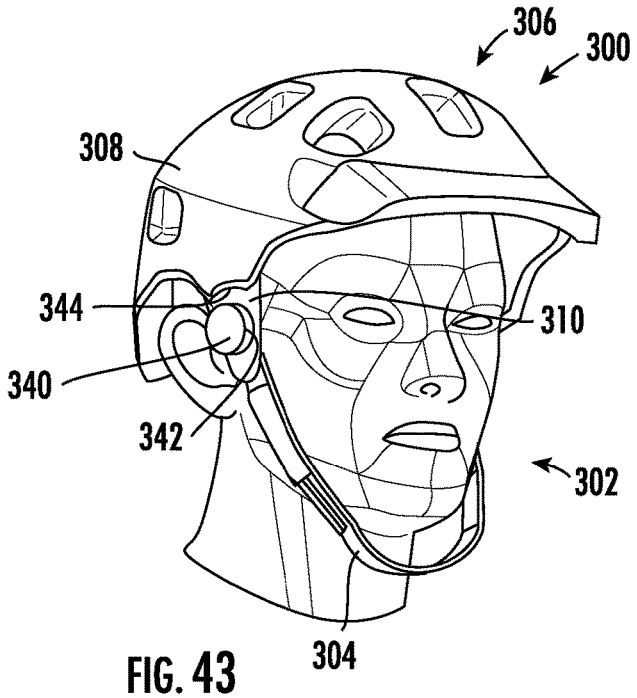
FIG. 43 is a first side perspective view of a helmet having a cable-type chin strap adjuster.
Figure 44:
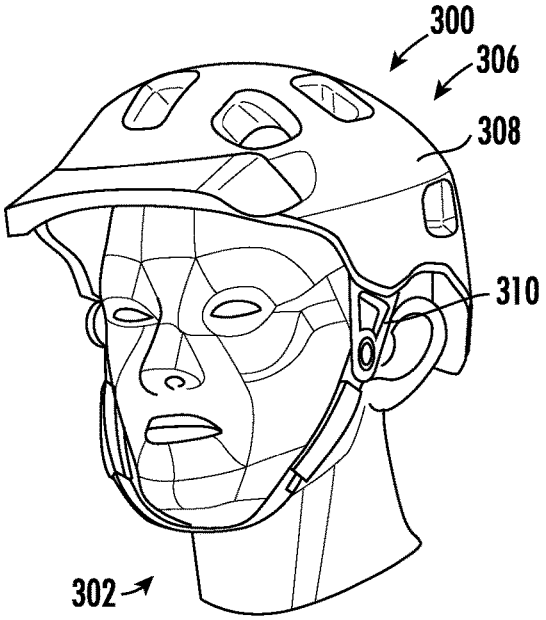
FIG. 44 is a second side perspective view of the helmet of FIG. 43 with the chin strap being tightened.
Figure 45:
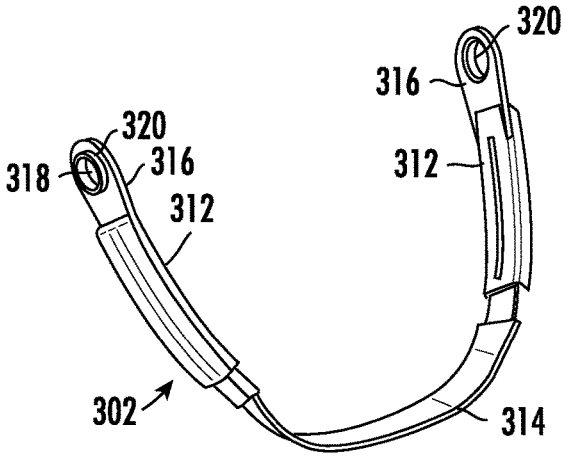
FIG. 45 is a front upper perspective view of the cable-type chin strap adjuster included in the helmet of FIG. 43.
Figure 46:
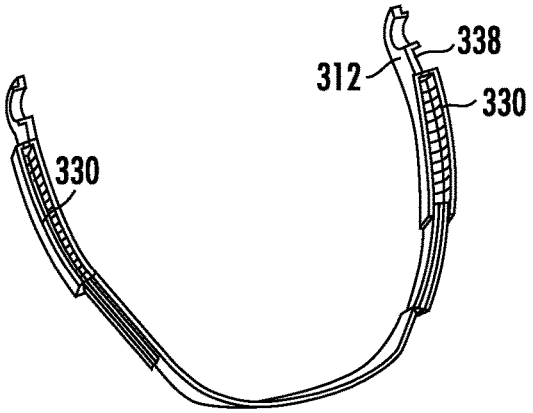
FIG. 46 is a rear upper perspective view of the cable-type chin strap adjuster included in the helmet of FIG. 43.
Figure 47:
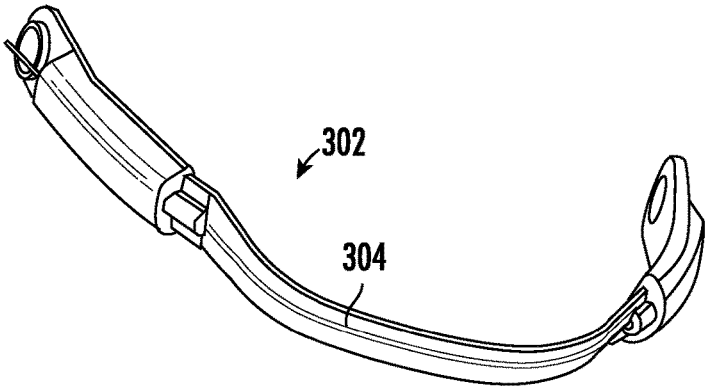
FIG. 47 is an enlarged lower perspective view of the cable-type chin strap adjuster.
Figure 48:
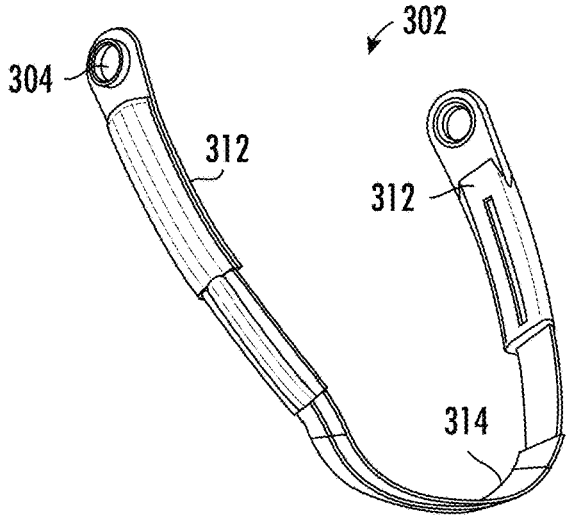
FIG. 48 is a front upper perspective view of the cable-type chin strap adjuster.
Figure 49:
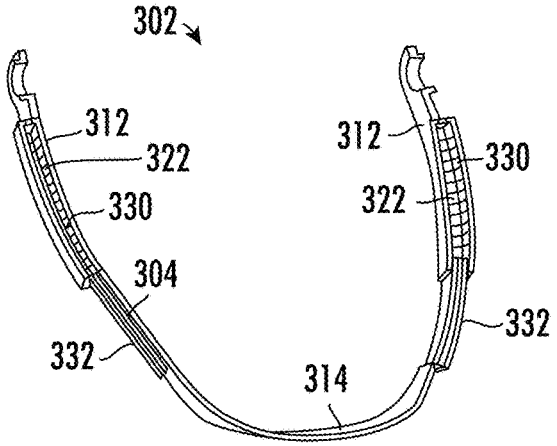
FIG. 49 is a front upper perspective sectional view of the cable-type chin strap adjuster of FIG. 48.
Figure 50:
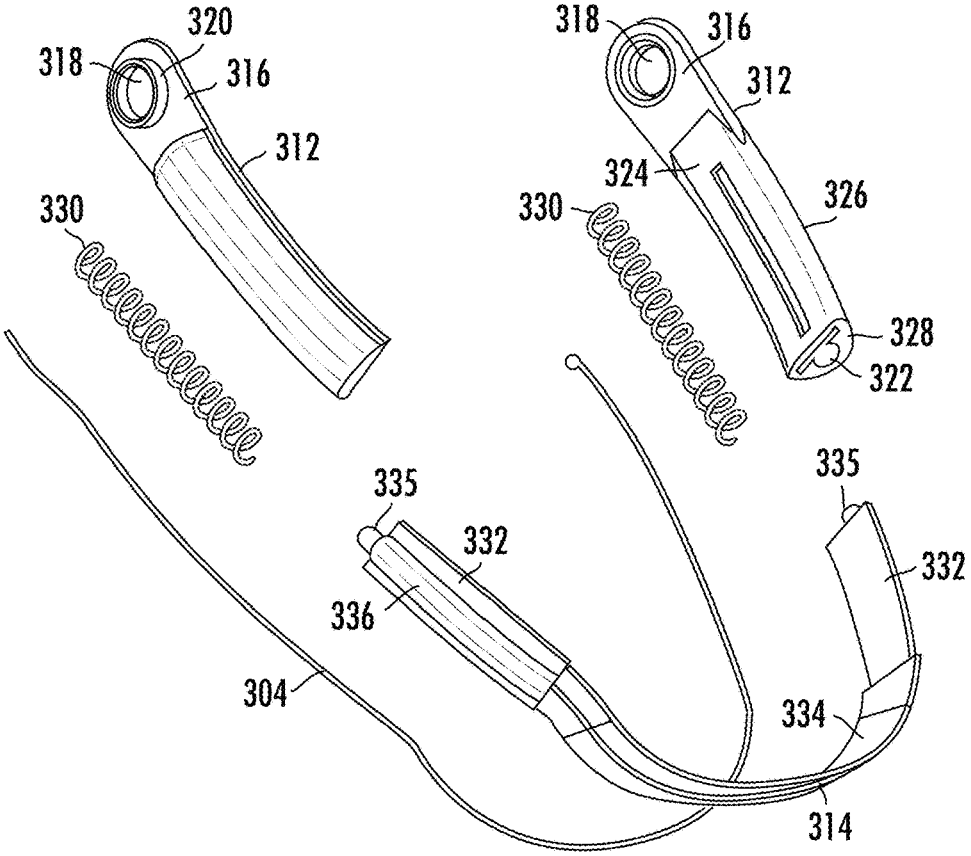
FIG. 50 is an exploded upper perspective view of the cable-type chin strap adjuster.

It is contemplated that the dial 340 may be located at various locations on the helmet 300, without departing from the spirit and scope of the present disclosure. As shown in FIGS. 43-44, the dial 340 may be located on the shell 306, and in particular, on a strap mount 310. The shell 306 may have a curved edge 344 that extends around the dial 340 to accommodate placement and use of the dial 340.

Figure 51:
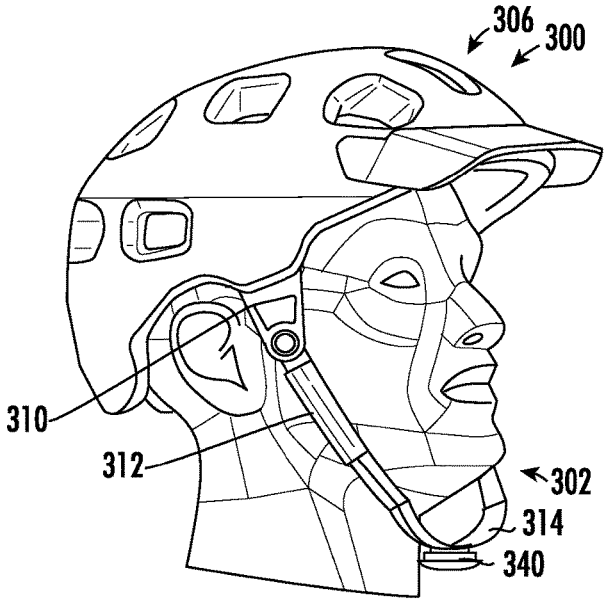
FIG. 51 is a perspective view of an embodiment of the helmet having a cable-type chin strap adjuster with an adjustment dial located on the chin strap.
Figure 52:
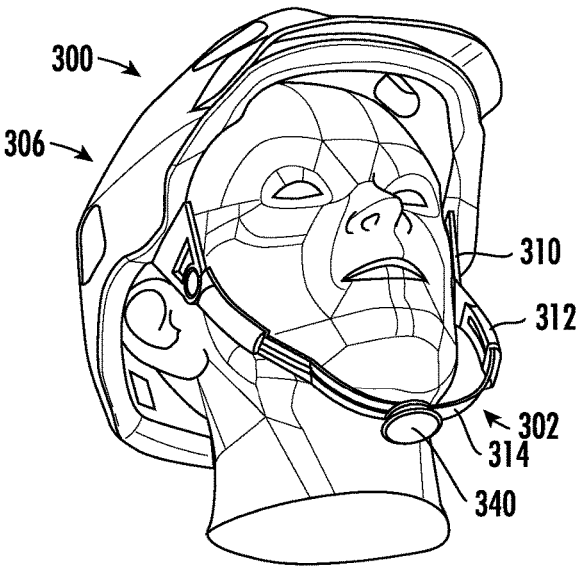
FIG. 52 is a lower perspective view of the helmet depicted in FIG. 51.
Figure 53:
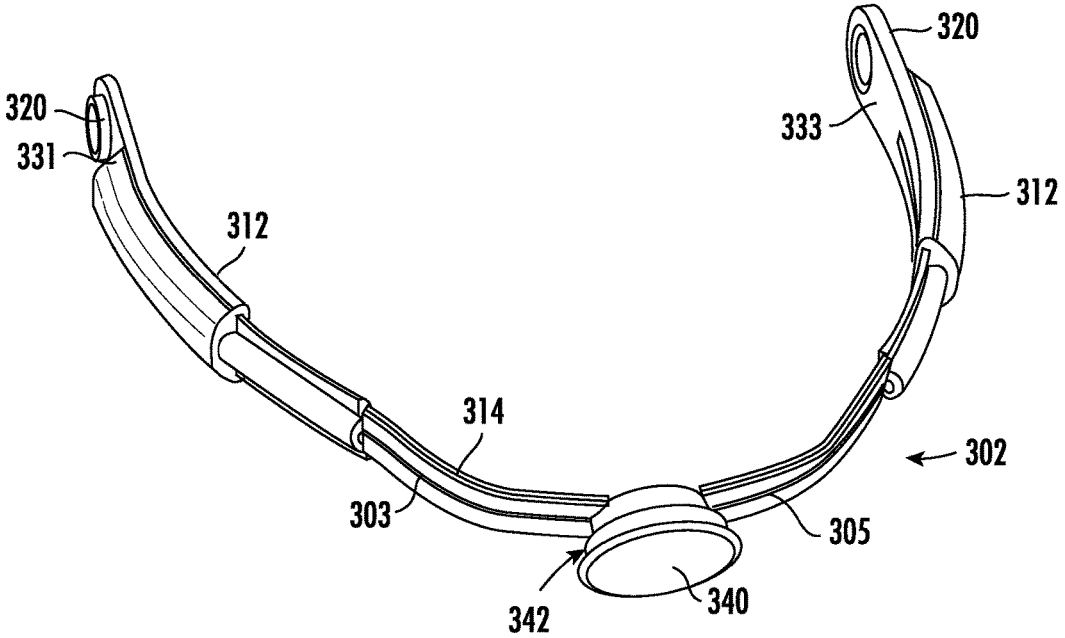
FIG. 53 is a lower perspective view of the cable-type chin strap adjuster having the adjustment dial located on the chin strap.
Figure 54:
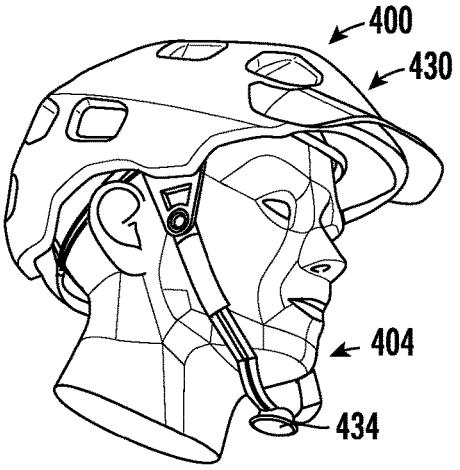
FIG. 54 is a lower perspective view of a helmet on a user, with the helmet having a cable-type head and chin strap adjuster.
Figure 55:
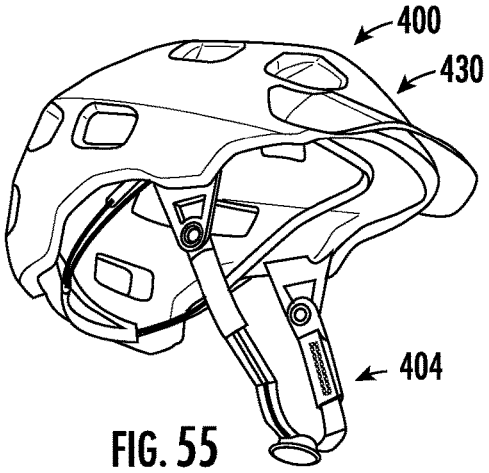
FIG. 55 is a lower perspective view of the helmet of FIG. 54.
Figure 56:
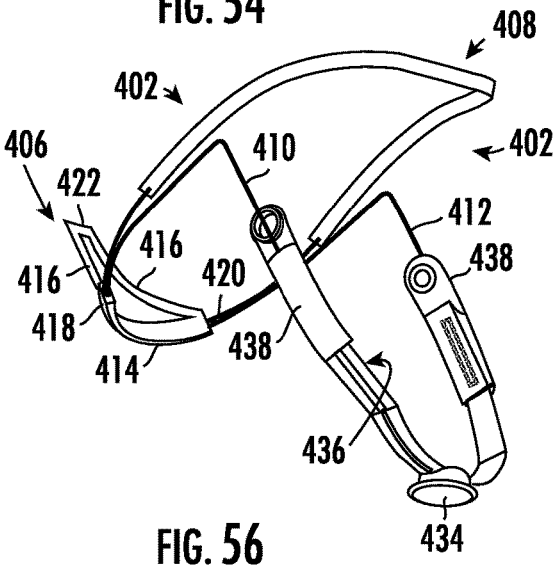
FIG. 56 is a first lower perspective view of the cable-type head and chin strap adjuster included in the helmet of FIG. 54.
Figure 57:
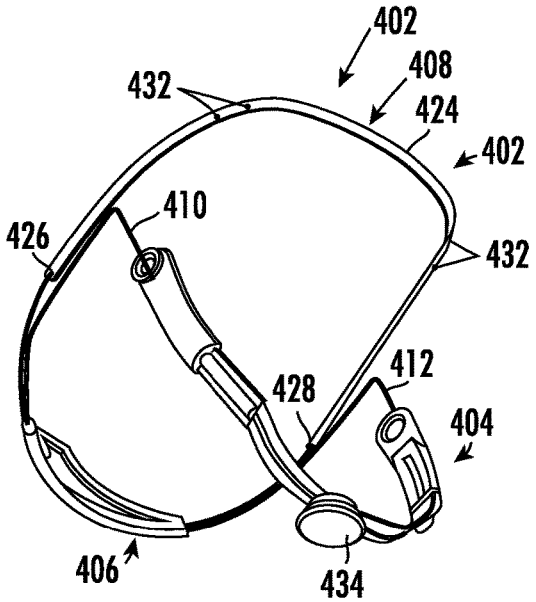
FIG. 57 is a second lower perspective view of the cable-type head and chin strap adjuster included in the helmet of FIG. 54.
Figure 58:
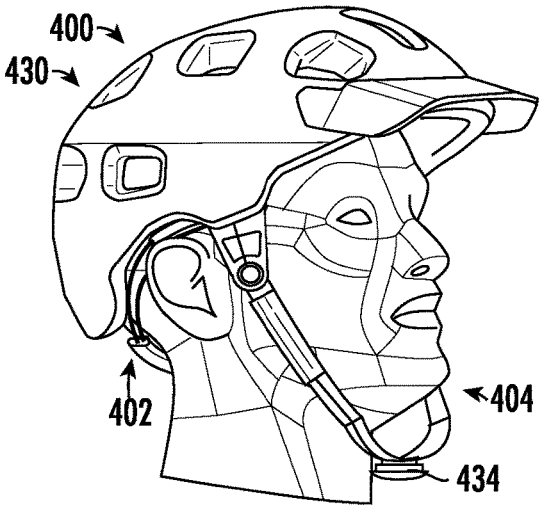
FIG. 58 is a lower perspective view of the helmet of FIG. 54 on the user, with perspective of FIG. 58 being different from the perspective depicted in FIG. 54.
Figure 59:
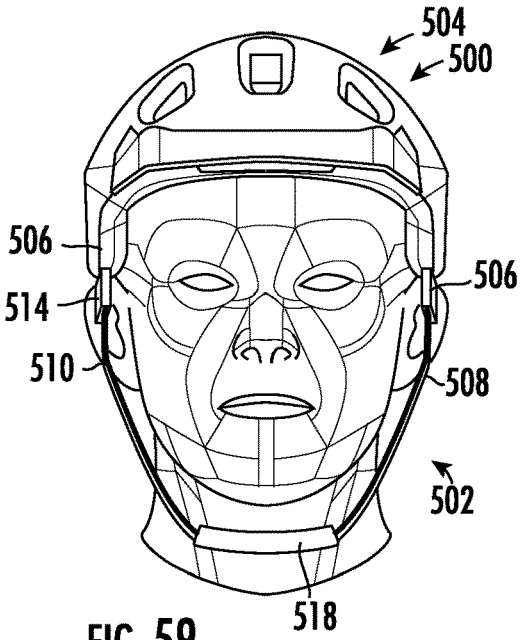
FIG. 59 is a front view of a helmet having a rack and pinion type chin strap adjuster.
Figure 60:
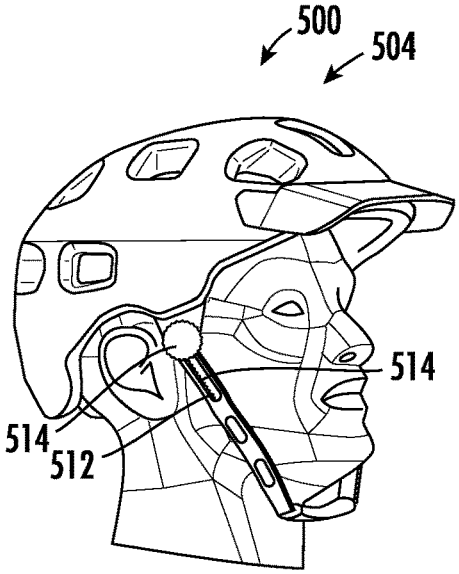
FIG. 60 is a first side perspective view of the helmet depicted in FIG. 59.
Figure 61:
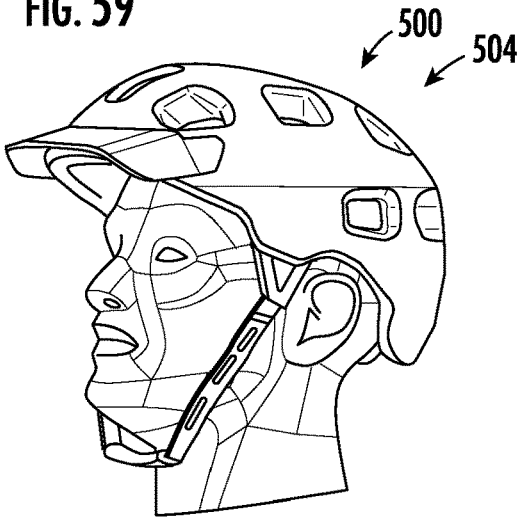
FIG. 61 is a second side perspective view of the helmet depicted in FIG. 59.
Figure 62:
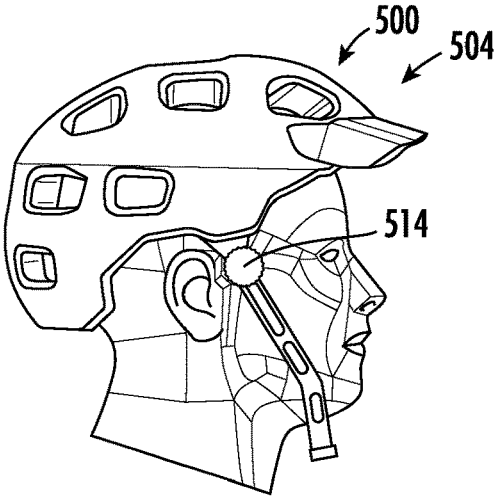
FIG. 62 is a side view of the helmet depicted in FIG. 59, with the chin strap being in a lengthened configuration.
Figure 63:
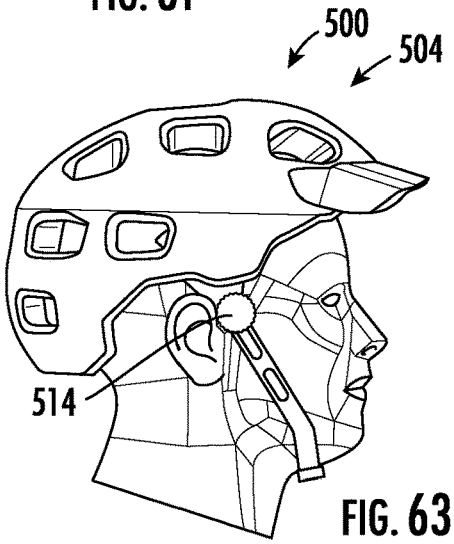
FIG. 63 is a side view of the helmet depicted in FIG. 59, with the chin strap being in a tightened configuration.
Figure 64:
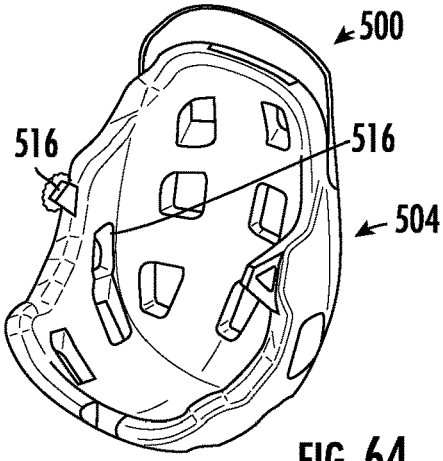
FIG. 64 is a lower perspective view of a helmet depicted in FIG. 59, with the chin strap having been removed.

FIGS. 51-53 show an alternative placement of the dial 340 on the chin strap 302. In particular, the dial 340 is shown as being attached to the intermediate segment 314, although it is contemplated that the dial 340 may also be connected to the lateral segments 312 without departing from the spirit and scope of the present disclosure. In the exemplary embodiment depicted in FIGS. 51-53, the dial 340 interfaces with two separate cables 303, 305 that may be simultaneously extended or retracted to selectively adjust the length of the chin strap 302. Each cable 303, 305 may have one end portion 331, 332 fixed to a respective lateral segment 312, while the other end portion interfaces with the dial 340. Thus, each cable 303, 305 may be capable of moving a respective lateral segment 312 relative to the intermediate segment 314. Each cable 303, 305 may be configured to overcome the biasing force applied by the respective spring located within the corresponding lateral segment 312. The use of two cables 303, 305, each connecting the dial 340 to the lateral segments 312 may result in simultaneous, equal, incremental adjustment of each lateral segment 312 relative to the intermediate segment 314. Thus, the length of the chin strap 302 may be balanced, without one side being longer than the other.

While the exemplary embodiment includes a chin strap 302 including a pair of lateral segments 312 and an intermediate segment 314 (e.g., 3 segments in total), it is contemplated that in other embodiments, the chin strap 302 may include only two segments that are moveable relative to each other to achieve desired length adjustability. In this regard, a cable may be coupled to one segment to facilitate movement of that segment relative to the other segment. A spring may act on the segments to allow for lengthening of the chin strap 302 when tension in the cable is relaxed.

Referring now to FIGS. 54-58, there is depicted another embodiment of the helmet 400, which includes an adjustable head support 402 for fitting the helmet 400 to the user's head. As will be described in more detail below, the head support 402 may be operatively coupled to the chin strap 404, such that the user may be able to simultaneously adjust the head support 402 when the chin strap 404 is adjusted.

The head support 402 may include a rear support body 406 and a front support body 408 operatively coupled to each other via cables 410, 412. The rear support body 406 may include a rear circumferential segment 414 and a pair of vertical segments 416 that extend from opposite ends of the rear circumferential segment 414. The rear circumferential segment 414 may include a channel formed therethrough to accommodate passage of the cables 410, 412 through the rear circumferential segment 414 between two ends 418, 420 of the rear circumferential segment 414. The vertical segments 416 may be curved or arcuate and may be connected at the upper ends by an upper segment 422.

The front support body 408 may be elongate and configured to extend around the front portion of the user's head, from one side of the user's head to the other side of the user's head. A central region 424 may be located between opposite end portions 426, 428 of the front support body 408, with the central region 424 being configured to extend over the user's forehead during use. Each end portion 426, 428 may have an aperture formed therein to facilitate connection with a respective cable 410, 412, as will be described in more detail below.

The front support body 408 may be connected to the shell 430 via buttons 432 configured to be snap-engageable with corresponding receptacles formed on the shell 430. The rear support body 406 may be coupled to the shell 430 via the operative connection between the front and rear support bodies 408, 406. In this regard, the connection between the front support body 408 facilitates operative engagement between the user's head and the shell 430, and by adjusting the size of the head support 402, the user may fit the helmet 400 to the size of the user's head.

As noted above, a pair of cables 410, 412 may be used to facilitate selective adjustment of both the head support 402 and the chin strap 404. A first cable 410 may extend from the dial 434 along a first side of the intermediate segment 436, through a channel in a first lateral segment 438, through a channel in the rear circumferential segment 414, and then connect to the aperture formed on end portion 428 of the front support body 408. In this regard, the lateral segment 438 through which the first cable 410 passes, and the end portion 428 of the front support body 408 are on opposite sides of the helmet 400. A second cable 412 may extend from the dial 434 along a second side of the intermediate segment 436, through a channel in a second lateral segment 438, through the channel in the rear circumferential segment 414, and then connect to the aperture formed on end portion 426 of the front support body 408. In this regard, the lateral segment 438 through which the second cable 412 passes, and the end portion 426 of the front support body 408 are on opposite sides of the helmet 400. The cables 410, 412 may be extended or retracted to selectively adjust the size/circumference/peripheral dimension of the head support 402. In particular, the head support 402 is configured to be transitional being an expanded configuration and a retracted configuration, with portions of the front and rear support bodies 408, 406 moving toward each other as the head support 402 transitions from the expanded configuration to the retracted configuration, and portions of the front and rear support bodies 408, 406 moving away from each other as the head support 402 transitions from the retracted configuration to the expanded configuration. In other words, an operative circumference collectively defined by the front and rear support bodies 408, 406 may increase as the head support 402 transitions from the retracted configuration toward the expanded configuration. Conversely, the operative circumference may decrease as the head support 402 transitions from the expanded configuration toward the retracted configuration.

Due to the use of two cables 410, 412, as the cables 410, 412 are tightened, both cables 410, 412 pull the front support body 408 from the opposite ends thereof toward the rear support body 406, until the head support 402 becomes tightened around the user's head to cause the springs 330 to compress. As the springs 330 compress, the chin strap 404 begins to tighten. Loosening the cables 410, 412 causes the chin strap 404 to lengthen, which allows the springs to transition the chin strap 404 toward the expanded position, and then the head support 402 will begin to loosen. In this way, head support 402 remains tight to the user's head until the chin strap 404 is fully expanded due to the urging of the springs 330. Effectively, helmet 400 includes a two-stage adjustment, with one stage of adjustment being associated with the head support 402 and a second stage of adjustment being associated with the chin strap 404. In one embodiment, the head support 402 tightens first, with the chin strap 404 tightening second, and with regard to loosening, the chin strap 404 loosens first, with the head support 402 loosening second. In this regard, by allowing the chin strap 404 to loosen first, a user may loosen the chin strap 404 while maintaining the head support 402 in a tight-fitting configuration, which may be desirable while the user makes a temporary stop and wanting to remove the tightness of the chin strap 404 while continuing to wear the helmet.

Figure 65:
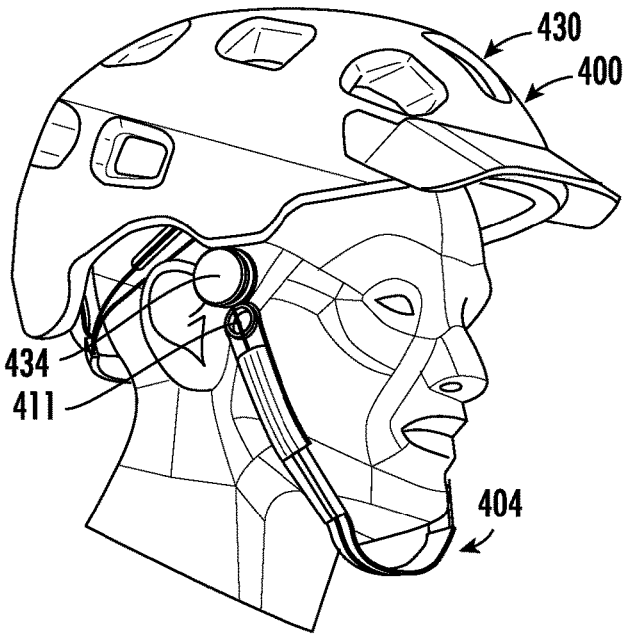
FIG. 65 is a first perspective view of a helmet on the head of a user, the helmet having a cable-type head and chin strap adjuster having a dial located on a strap mount.
Figure 66:
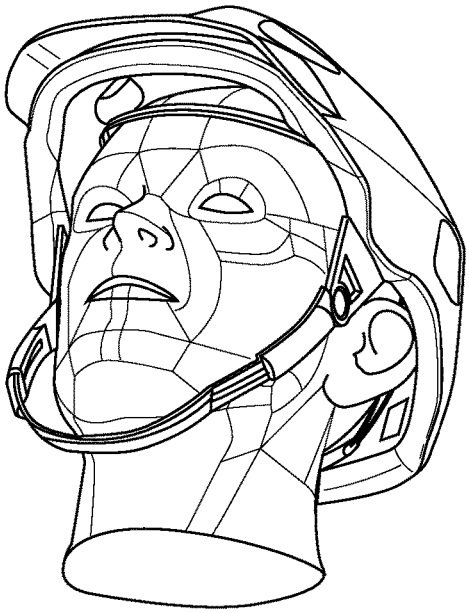
FIG. 66 is a second perspective view of the helmet of FIG. 65 on the head of the user.
Figure 67:
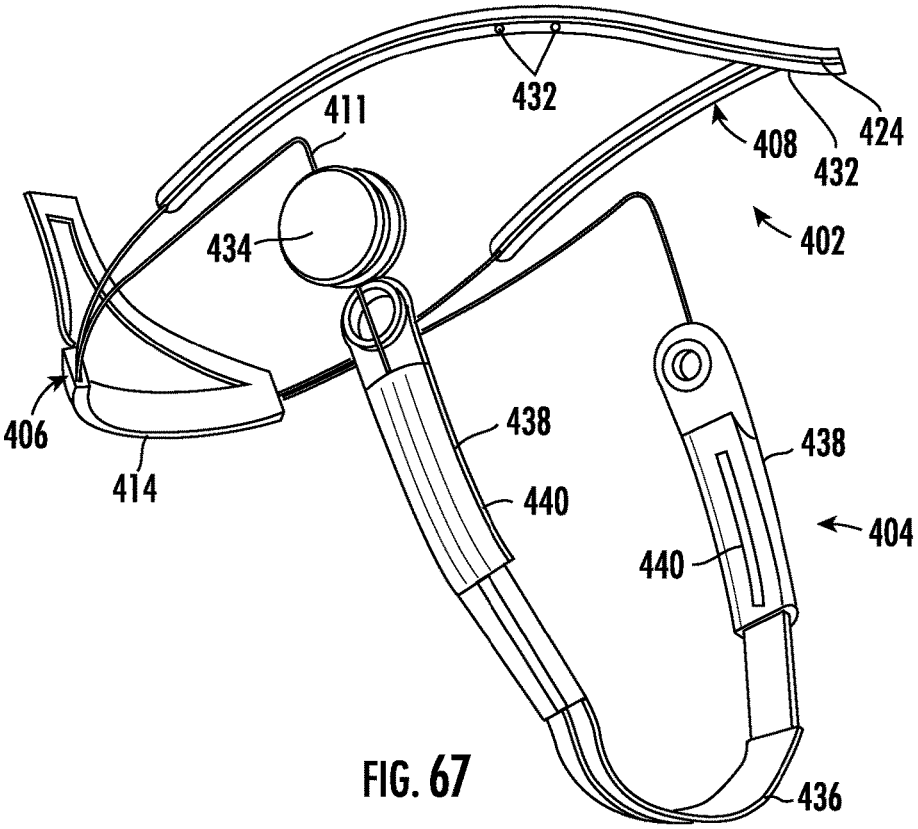
FIG. 67 is a perspective view of the cable-type head and chin strap adjuster used on the helmet of FIG. 65.

Although two cables 410, 412 are shown in FIGS. 54-58, it is contemplated that in alternative embodiments, a single cable may be used. FIGS. 65-67 show an example of a single cable system. From the dial 434 shown in FIG. 67, the cable 411 extends upwardly and is routed through a cable guide in the main body of the shell 430, through the rear support 406, through the front support 408, through the rear support 406, through another cable guide in the main body of the shell 430, and then through/around the chin strap 404.

The chin strap 404 and the head support 402 may be operatively coupled to each other to facilitate adjustment of both the chin strap 404 and the head support 402 through rotation of the dial 434. In this regard, a single modality, e.g., the dial 434, may facilitate adjustment of both the chin strap 404 and the head support 402. When the user tightens chin strap 404 and head support 402, the head support 402 may be tightened first due to the springs 440 in the chin strap 404, and only after the head support 402 is somewhat tightened to the user's head does the chin strap 404 begin to tighten. Accordingly, the user may tighten and loosen the chin strap 404 without loosening the head support 402, unless the chin strap 404 is at full length.

It is understood that other embodiments of the chin strap 404 may not have springs 440. However, the springs 440 facilitate the two-stage tightening, wherein a first stage entails tightening of the head support 402, and then a subsequent second stage entails tightening of the chin strap 404.

Figure 68:
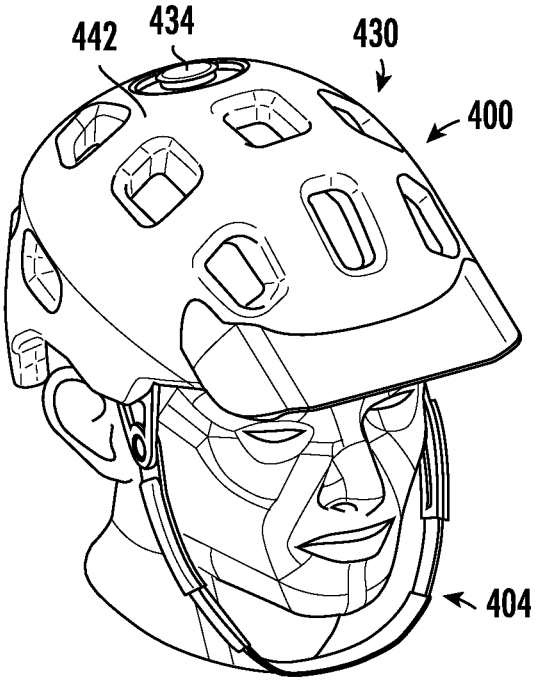
FIG. 68 is an upper perspective view of a helmet on the head of a user, the helmet having a cable-type head and chin strap adjuster having a dial located on a helmet shell.
Figure 69:
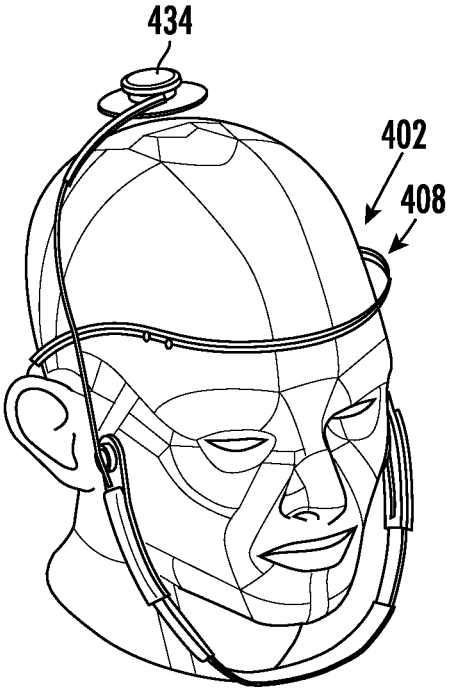
FIG. 69 is an upper perspective view of the cable-type head and chin strap adjuster of FIG. 68 on the head of the user, with the helmet shell having been removed.
Figure 70:
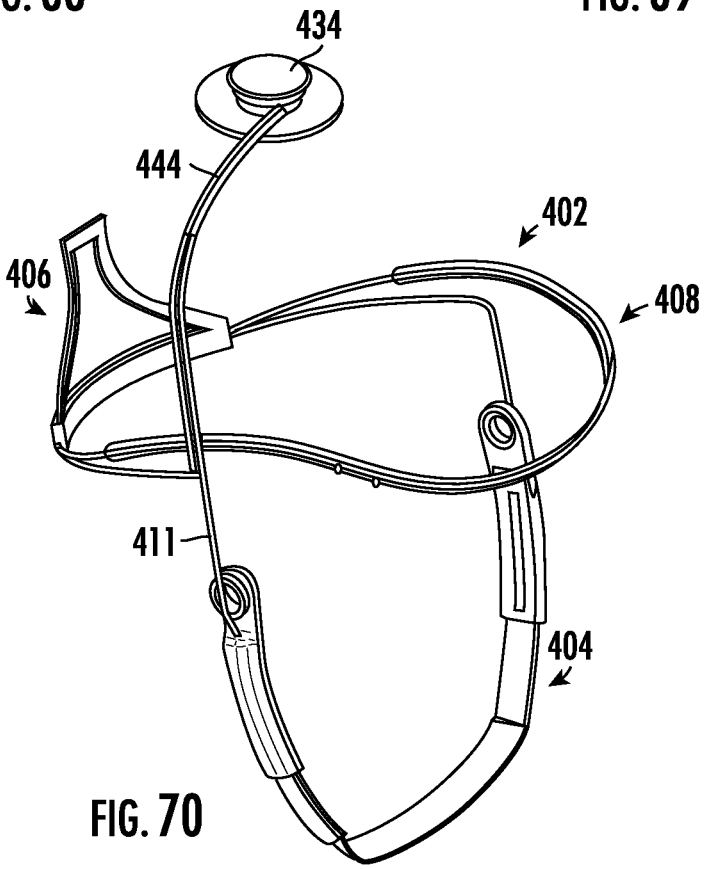
FIG. 70 is an upper perspective view of the cable-type head and chin strap adjuster of FIG. 68.

FIGS. 68-70 show another embodiment of the helmet 400 with the dial 434 located on the main body 442 of the shell 430. The cable 411 may be routed through a guide 444 in the helmet shell 430, as well as through the rear support 406, the front support 408, through the chin strap 404, and back to the dial 434.

The various embodiments depicted herein demonstrate that the dial may be integrated into any portion of the helmet, such as on the main body of the shell, on the strap mount, or on the chin strap. Furthermore, the helmet may include a single cable, or multiple cables, as may be desired. Moreover, although the exemplary embodiments, show a single dial for adjusting the head support and the chin strap, primarily to simplify use of the helmet, it is contemplated that other embodiments may include separate dials or adjustment mechanisms for the head support and the chin strap. In other words, the helmet may include two dials; one for adjusting the chin strap, and another for adjusting the head support.

It is also contemplated that one embodiment of the head support and chin strap may allow for automatic tightening adjustment to the user's head. For instance, the user may press a button (e.g., the dial), which may cause the device to automatically tighten the cables until the head support and the chin strap are snug on the user. A reel operatively connected to the cables may be biased in the direction which pulls the cables in, such that when the button is pushed, the bias on the reel pulls the cables in, which in turn, tightens the head support and chin strap. To loosen the chin strap and head support, the user may press and hold the button, while pulling on the chin strap to lengthen the chin strap. When the button is released, the reel may lock in place, to hold the extended position of the chin strap. The user may also be able to manually extend the head support, either by moving the helmet over the user's head or pulling on one of the head supports while pressing the button. The automatic tightening may also be facilitated through one or more small electronic motors which can automatically adjust the head support and chin strap as may be desired, e.g., either lengthening or tightening. For instance, the motors may be in operative communication with a controller which may be programmed to recognize a preferred loosened configuration as well as a preferred tightened configuration. Thus, the user may simply touch a button, which may cause the controller to facilitate adjustment to the preferred tightened position. Subsequent actuation of the button may cause the controller to facilitate adjustment to the preferred loosened position.

Referring now to FIGS. 59-64, there is depicted another embodiment of the helmet 500 having a rack and pinion type adjustment mechanism for adjusting the length of chin strap 502. In more detail, the chin strap 502 may be coupled to a shell 504 at strap mounts 506, and may be formed of a single, integral body having a fixed end portion 508 and an adjustable end portion 510. The fixed end portion 508 may be fixed to the strap mount 506, and thus, may not move relative to the strap mount 508 during use of the chin strap 502. The adjustable end portion 510 may include an elongate slot 512 formed therein. Teeth 515 are formed on the inner surface of the elongate slot 512, which are configured to operatively engage with corresponding teeth on an adjustment knob/dial 514. The chin strap 502 may define a length as the distance along the chin strap 502 between the dial 514 and the portion of the chin strap 502 fixedly connected to the strap mount 506. The length may be adjusted by rotating the dial 514, wherein rotation of the dial 514 in a first direction results in lengthening of the chin strap 502, while rotation of the dial 514 in an opposing second direction results in tightening of the chin strap 502. When the chin strap 502 is tightened, the portion of the strap 502 extending upwardly beyond the dial 514 increases. Thus, the strap mount 506 and the shell main body may include channels 516 formed therein, which may receive a portion of the chin strap 502 extending upwardly beyond the dial 514. In this regard, that portion of the chin strap 502 may be shielded from the user's head for enhanced comfort.

When the chin strap 502 is sufficiently loosened, the helmet 500 may be placed on the user's head or removed from the user's head. Alternatively, the strap 502 may be designed to be disengaged from the shell to allow for helmet installation or removal.

A chin pad 518 may be coupled to the chin strap 502 and may be slidable along the chin strap 502 to facilitate centering of the chin pad 518 under the user's chin.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A helmet comprising:

a shell sized and configured to be placeable on the head of a user;

a chin strap coupled to the shell, the chin strap being formed from a semi-rigid material and having at least a first segment and a second segment slidable relative to the first segment, the first segment including a guide channel extending therein, the guide channel having a first end and a second end, the second segment being receivable within the first end of the guide channel and moveable within the guide channel toward the second end, the chin strap having two attachment portions, the chin strap being connectable to the shell at the two attachment portions, the chin strap defining a length as the distance along the chin strap between the two attachment portions, the chin strap being configured to be selectively transitional between a lengthened configuration and a tightened configuration, the length decreasing as the chin strap transitions from the lengthened configuration toward the tightened configuration; and a spring extending along a spring axis and located within the guide channel, the spring being configured to apply a biasing force on the first and second segments which urges the first and second segments in opposite directions, the elongate spring being configured to expand along the spring axis as the chin strap transitions from the tightened configuration towards the lengthened configuration.

2. The helmet recited in claim 1, further comprising a cable extending between the first and second segments to facilitate movement of the first and second segments relative to each other.

3. The helmet recited in claim 2, wherein the cable is configured to facilitate application of a force to overcomes the spring to transition the first and second segments toward the tightened configuration.

4. The helmet recited in claim 2, further comprising a dial coupled to the cable to facilitate movement of the cable relative to the first and second segments.

5. The helmet recited in claim 4, wherein the dial is coupled to the chin strap.

6. The helmet recited in claim 1, wherein the chin strap includes a third segment, the second segment extending between the first and third segments and being moveable relative to the first and third segments.

7. The helmet recited in claim 1, wherein the chin strap is pivotable relative to shell.

8. The helmet recited in claim 1, wherein the shell includes a main body having a lower peripheral edge, and a pair of strap mounts coupled to the main body in spaced relation to each other and extending from the lower peripheral edge, the chin strap being coupled to the shell at the pair of strap mounts.

9. The helmet recited in claim 1, wherein the spring is a helical-shaped spring.

10. The helmet recited in claim 1, wherein one of the first and second segments includes a spring retaining post configured the spring to facilitate engagement between the spring and the one of the first and second segments.

* * * * *